US010656556B2

(12) United States Patent
Egami et al.

(10) Patent No.: US 10,656,556 B2
(45) Date of Patent: May 19, 2020

(54) DEVELOPING DEVICE HAVING CONVEYING MEMBER FOR STABLY CONVEYING DEVELOPER, DEVELOPER CONTAINER, PROCESS CARTRIDGE, AND IMAGE FORMING APPARATUS

(71) Applicant: CANON KABUSHIKI KAISHA, Tokyo (JP)

(72) Inventors: Yasuyuki Egami, Tokyo (JP); Masanari Morioka, Yokohama (JP); Tetsushi Uneme, Kawasaki (JP); Shinichi Nishida, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 257 days.

(21) Appl. No.: 15/873,706

(22) Filed: Jan. 17, 2018

(65) Prior Publication Data

US 2018/0203378 A1 Jul. 19, 2018

(30) Foreign Application Priority Data

Jan. 19, 2017 (JP) ..... 2017-007692
Nov. 21, 2017 (JP) ..... 2017-223651

(51) Int. Cl.
*G03G 15/08* (2006.01)
*G03G 21/18* (2006.01)

(52) U.S. Cl.
CPC ..... *G03G 15/0865* (2013.01); *G03G 15/0889* (2013.01); *G03G 21/18* (2013.01)

(58) Field of Classification Search
CPC . G03G 15/0865; G03G 15/0889; G03G 21/18
See application file for complete search history.

(56) References Cited

U.S. PATENT DOCUMENTS 5,270,785 A * 12/1993 Kita ..... G03G 15/0877 222/DIG. 1
6,456,810 B1 * 9/2002 Deguchi ..... G03G 15/0875 399/254

FOREIGN PATENT DOCUMENTS

JP H05-281857 A 10/1993
JP 2002-116613 A 4/2002
JP 2003-29532 A 1/2003
JP 2003-173083 A 6/2003
(Continued)

*Primary Examiner* — Susan S Lee
(74) *Attorney, Agent, or Firm* — Canon USA, Inc., IP Division

(57) ABSTRACT

A developing device includes a developing frame including a developing chamber, an accommodating chamber accommodating toner, and a partition wall provided with an opening connecting the developing chamber and the accommodating chamber. The developing device further includes an agitating member agitating the developer in the accommodating chamber, a shaft member including an attachment portion to which the agitating member is attached, and a conveying sheet conveying the toner. The conveying sheet includes a fixed portion fixed to the inner wall of the developing frame forming the accommodating chamber, and a displacement portion that is movable toward the opening by coming into contact with the agitating member. The rotation center of the shaft member is provided within an imaginary circle centered at the boundary point between the fixed portion and the displacement portion and passing through the distal end of the displacement portion.

20 Claims, 11 Drawing Sheets

(56) References Cited

FOREIGN PATENT DOCUMENTS

| | | | | |
|---|---|---|---|---|
| JP | 2013-178413 | A | | 9/2013 |
| JP | 2013-238750 | A | | 11/2013 |
| JP | 2016114842 | A | * | 6/2016 |

* cited by examiner

DEVELOPING DEVICE HAVING CONVEYING MEMBER FOR STABLY CONVEYING DEVELOPER, DEVELOPER CONTAINER, PROCESS CARTRIDGE, AND IMAGE FORMING APPARATUS

BACKGROUND OF THE INVENTION

Field of the Invention

The present invention relates to a developing device, a developer container, and a process cartridge used in an image forming apparatus.

Description of the Related Art

An electrophotographic image forming apparatus (hereinafter referred to as "image forming apparatus") forms an image on a recording material by using an electrophotographic image forming process. Examples of the image forming apparatus include a copying machine, a facsimile machine, a printer such as a laser beam printer, an LED (Light Emitting Diode) printer, and a multifunction printer thereof.

In the electrophotographic image forming process, a developing device develops an electrostatic latent image formed on an electrophotographic photosensitive member (hereinafter referred to as "photosensitive member") with a developer to make it into a visible image. A process cartridge is a cartridge in which at least a developing device is integrated as an image forming process unit acting on a photosensitive member and that is detachably attached to the main body of an image forming apparatus.

In an image forming apparatus such as a printer using an electrophotographic image forming process, first, a photosensitive member serving as an image bearing member is uniformly charged. Then, an electrostatic latent image is formed on the photosensitive member by selectively exposing the photosensitive member. Subsequently, the electrostatic latent image is supplied with toner serving as a developer so as to be developed as a toner image and visualized, and this toner image is transferred to a recording material such as paper or plastic sheet. Then, the toner image transferred to the recording material is heated and pressurized and thermally fixed to the recording material to record the image.

An image forming apparatus using an electrophotographic image forming process generally requires replenishment of developer and maintenance of various image forming process units. It is necessary to facilitate replenishment of developer and maintenance of various process units. For that purpose, a process cartridge (hereinafter referred to as "cartridge") in which a photosensitive member, a charging unit, a developing unit, a cleaning unit and so forth are integrated is detachably attached to the main body of an image forming apparatus. By virtue of such a process cartridge system, the user themselves can perform maintenance of the apparatus in the form of cartridge exchange. Therefore, operability can be improved.

Color image forming apparatuses that form color images using developers of a plurality of colors have become widespread. As a color image forming apparatus, a so-called in-line type image forming apparatus is known in which photosensitive members corresponding to respective image forming operations using developers of a plurality of colors are arranged in a line along the moving direction of the surface of a transfer-receiving member to which toner images are transferred. In some in-line type color image forming apparatuses, a plurality of photosensitive members are arranged in a line in a direction (for example, a horizontal direction) intersecting with a vertical direction (gravitational direction). The in-line type is desirable in that it is easier to respond to requests such as higher image formation speed and development to a multi-function printer.

In some in-line type image forming apparatuses, as disclosed in Japanese Patent Laid-Open No. 2003-173083, a plurality of photosensitive members are arranged below an intermediate transfer member serving as a transfer-receiving member or a recording material bearing member for conveying a recording material serving as a transfer-receiving member. When photosensitive members are arranged below an intermediate transfer member or a recording material bearing member, the intermediate transfer member or the recording material bearing member is interposed between the photosensitive members and a fixing device in the main body of an image forming apparatus. As a result, the fixing device serving as a heat source and the cartridge can be arranged at a distance from each other. Therefore, it is advantageous that the cartridge is not easily affected by heat from the fixing device.

On the other hand, developing systems of the developing device generally include a contact developing system in which development is carried out in a state where the developer bearing member and the photosensitive member are in contact with each other, and a non-contact developing system in which development is carried out in a state where a predetermined interval is provided between the developer bearing member and the photosensitive member. Methods of supplying developer to the developer bearing member include a method in which developer is supplied using a conveying member from a developer accommodating chamber accommodating the developer to a developing chamber provided with the developer bearing member through an opening connecting both chambers.

In the case where the photosensitive members are disposed below the intermediate transfer member or the recording material bearing member, it is necessary for the developing device to convey the developer against gravity. In Japanese Patent Laid-Open No. 2003-173083, as a unit for conveying developer to a developing chamber disposed above the developer accommodating chamber, a conveying member composed of a flexible sheet member is provided at the distal end of an agitating member rotatably provided for agitating developer. Further, a receiving member for temporarily storing the developer is disposed below the developer bearing member, a flexible scraper is attached to the distal end of the receiving member, the developer is delivered by bringing the conveying member and the scraper into contact with each other, and the developer is conveyed to the developing chamber.

In such a configuration, if the supply of toner to the developing chamber can only be performed little by little, when outputting a high-density image, since the supply of toner is insufficient, it is necessary to enlarge the developing chamber in advance.

SUMMARY OF THE INVENTION

The present invention provides a developing device capable of suppressing falling of developer from a conveying member when conveying developer against gravity.

In an aspect of the present invention, a developing device includes a frame including a developing chamber provided with a developer bearing member, an accommodating chamber accommodating developer, and a partition wall separating the developing chamber and the accommodating chamber from each other and provided with an opening connecting the developing chamber and the accommodating chamber, an agitating member agitating the developer in the accommodating chamber, a shaft member rotatably supported in the accommodating chamber, the shaft member being located below the opening in the gravitational direction and having an attachment portion to which the agitating member is attached, and a conveying member conveying the developer in the accommodating chamber. The conveying member includes a fixed portion fixed to the inner wall of the frame forming the accommodating chamber and a displacement portion movable relative to the opening. The displacement portion is located between the opening and the shaft member, and is movable from below the opening in the gravitational direction toward the opening by coming into contact with the agitating member. In a direction perpendicular to the rotational axis of the shaft member, the distance between the rotational axis and the attachment portion is shorter than the shortest distance between the attachment portion and the inner wall, and the rotational axis is located within an imaginary circle centered at the boundary point between the fixed portion and the displacement portion and passing through the distal end of the displacement portion.

In another aspect of the present disclosure, a developer container includes a frame including a first chamber, a second chamber accommodating developer, and a partition wall separating the first chamber and the second chamber from each other and provided with an opening connecting the first chamber and the second chamber, an agitating member agitating the developer in the second chamber, a shaft member rotatably supported in the second chamber, the shaft member being located below the opening in the gravitational direction and having an attachment portion to which the agitating member is attached, and a conveying member conveying the developer in the second chamber. The conveying member includes a fixed portion fixed to the inner wall of the frame forming the second chamber and a displacement portion movable relative to the opening. The displacement portion is located between the opening and the shaft member, and is movable from below the opening in the gravitational direction toward the opening by coming into contact with the agitating member. In a direction perpendicular to the rotational axis of the shaft member, the distance between the rotational axis and the attachment portion is shorter than the shortest distance between the attachment portion and the inner wall, and the rotational axis is located within an imaginary circle centered at the boundary point between the fixed portion and the displacement portion and passing through the distal end of the displacement portion.

Further features of the present disclosure will become apparent from the following description of exemplary embodiments with reference to the attached drawings.

DESCRIPTION OF THE EMBODIMENTS

A developing device, a process cartridge, and an image forming apparatus according to an embodiment of the present disclosure will be specifically described with reference to the drawings. However, the present disclosure is not limited to the functions, materials, shapes, relative arrangements thereof, and the like of the components described in the following embodiment.

Image Forming Apparatus

Figure 1:
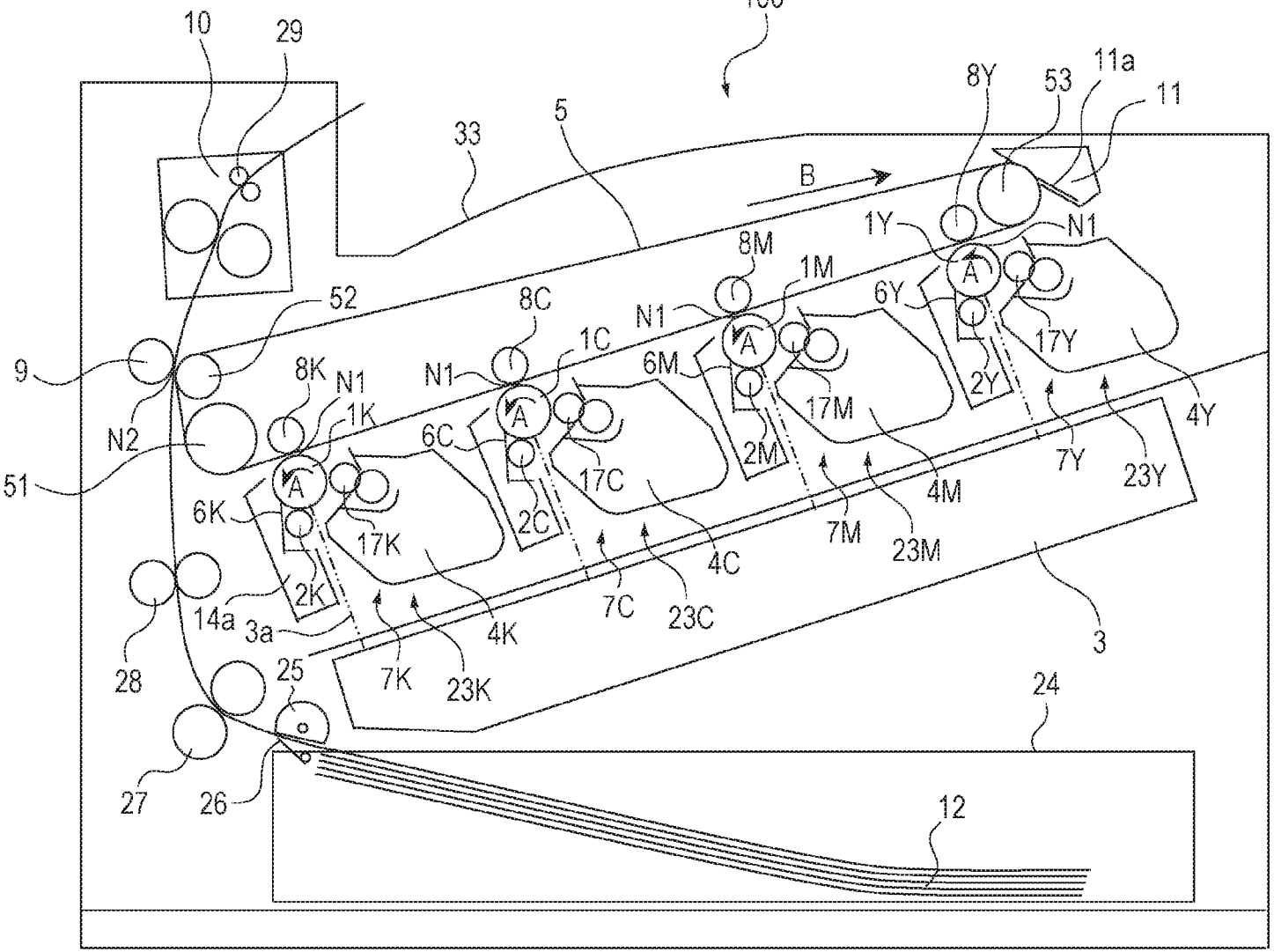
FIG. 1 is a sectional explanatory view showing the configuration of an image forming apparatus according to the present disclosure.

First, the configuration of an image forming apparatus 100 will be described with reference to FIG. 1. FIG. 1 is a sectional explanatory view showing the configuration of an image forming apparatus 100 according to the present disclosure. The image forming apparatus 100 shown in FIG. 1 is an example of an image forming apparatus using an electrophotographic method.

The image forming apparatus 100 shown in FIG. 1 is configured in an in-line system in which photosensitive drums 1Y, IM, 1C, and 1K of respective colors of yellow Y, magenta M, cyan C, and black K serving as a plurality of image bearing members are arranged in a line. Further, it is an example of a full-color laser beam printer using an intermediate transfer method having an intermediate transfer belt 5 as an intermediate transfer member.

The image forming apparatus 100 can form a full color image on a recording material 12 such as paper, plastic sheet, cloth or the like by using the developer of each color according to the image information. The image information is input to the main body of the image forming apparatus 100 from an image reading apparatus connected to the main body of the image forming apparatus 100 or a host apparatus such as a personal computer communicably connected to the main body of the image forming apparatus 100.

The image forming apparatus 100 has image forming units 23Y, 23M, 23C, and 23K of respective colors of yellow Y, magenta M, cyan C, and black K as a plurality of image forming units 23. The configuration and the operation of the image forming unit 23 of each color are substantially the same except that the color of the image to be formed is different. For the sake of convenience of explanation, explanation may be given using the image forming unit 23 as a representative of the image forming units 23Y, 23M, 23C, and 23K in some cases. The same applies to each image forming process unit. In this embodiment, the image forming units 23 are arranged in a line in a direction intersecting the vertical direction (vertical direction in FIG. 1).

The image forming apparatus 100 has four photosensitive drums 1 that are drum type electrophotographic photosensitive members arranged side by side in a direction intersecting with the vertical direction (vertical direction in FIG. 1) as a plurality of image bearing members. Each of the photosensitive drums 1 is rotationally driven in the direction of arrow A in FIG. 1 by a driving unit (driving source) (not shown). Around the photosensitive drum 1, there are provided a charging roller 2 serving as a charging unit, a laser scanner unit 3 serving as an exposing unit, a developing device 4 serving as a developing unit, and a cleaning blade 6 serving as a cleaning unit.

Further, an intermediate transfer belt 5 is provided so as to face each photosensitive drum 1. The intermediate transfer belt 5 is stretched by a driving roller 51, a secondary transfer opposing roller 52, and a driven roller 53 so as to be rotatable in the direction of arrow B in FIG. 1. On the inner peripheral surface side of the intermediate transfer belt 5, there is provided a primary transfer roller 8 serving as a primary transfer unit opposed to each photosensitive drum 1 with the intermediate transfer belt 5 therebetween.

The charging roller 2 uniformly charges the surface of the photosensitive drum 1. The uniformly charged surface of the photosensitive drum 1 is irradiated with laser light 3*a* based on image information emitted from the laser scanner unit 3. An electrostatic latent image is thereby formed on the surface of the photosensitive drum 1.

Toner 22 (developer) is supplied from the developing device 4 to the electrostatic latent image formed on the surface of the photosensitive drum 1. The electrostatic latent image formed on the surface of the photosensitive drum 1 is thereby developed as a toner image. The toner image formed on the surface of the photosensitive drum 1 is primarily transferred onto the outer peripheral surface of the intermediate transfer belt 5 by the primary transfer roller 8. The residual toner remaining on the surface of the photosensitive drum 1 after the primary transfer is scraped off by the cleaning blade 6 and recovered to a removed toner chamber 14*a*.

A charging position by the charging roller 2, an exposure position by the laser scanner unit 3, a developing position by the developing device 4, a primary transfer position to the intermediate transfer belt 5, and a cleaning position by the cleaning blade 6 are provided in this order in the rotation direction of the photosensitive drum 1 indicated by arrow A in FIG. 1.

In the developing device 4 of this embodiment, a non-magnetic one-component developer is accommodated as a developer. In the developing device 4 of this embodiment, a developing roller 17 serving as a developer bearing member is brought into contact with the photosensitive drum 1 to perform reversal development. That is, in the developing device 4 of this embodiment, toner 22 charged to the same polarity as the charging polarity of the photosensitive drum 1 (negative polarity in this embodiment) is attached to a portion of the surface of the photosensitive drum 1 where charge has been attenuated by exposure (image portion, exposed portion). The electrostatic latent image on the surface of the photosensitive drum 1 is thereby developed as a toner image.

The photosensitive drum 1, and the charging roller 2, the developing device 4, and the cleaning blade 6 serving as image forming process units acting on the photosensitive drum 1 of this embodiment are integrated into a cartridge and configured as a process cartridge 7. The process cartridge 7 is configured to be attachable to and detachable from the main body of the image forming apparatus 100 via attachment units such as an attachment guide (not shown) and a positioning member (not shown) provided in the main body of the image forming apparatus 100.

In this embodiment, the process cartridges 7 of respective colors have the same shape, and toners 22 of respective colors of yellow Y, magenta M, cyan C, and black K are accommodated in the developing devices 4 of the process cartridges 7 of respective colors. In this embodiment, an example of the process cartridge 7 in which the photosensitive drum 1 and the developing device 4 are integrally provided will be described. In addition, the present disclosure can also be applied to a case where the developing device 4 is configured as a developing cartridge detachably attachable to the main body of the image forming apparatus 100 by itself.

The outer circumferential surface of the intermediate transfer belt 5 formed of an endless belt serving as an intermediate transfer member comes into contact with the surfaces of all the photosensitive drums 1 and rotates in the direction of arrow B in FIG. 1. The intermediate transfer belt 5 is looped over the driving roller 51, the secondary transfer opposing roller 52, and the driven roller 53 serving as a plurality of supporting members.

On the inner peripheral surface side of the intermediate transfer belt 5, four primary transfer rollers 8 serving as primary transfer units are provided side by side so as to face respective photosensitive drums 1. The primary transfer rollers 8 are biased by biasing units (not shown) to press the intermediate transfer belt 5 against the surfaces of the photosensitive drums 1. Primary transfer nip portions N1 where the outer peripheral surface of the intermediate transfer belt 5 is in contact with the surfaces of the photosensitive drums 1 are thereby formed.

A primary transfer bias of a polarity (positive polarity in this embodiment) opposite to the normal charging polarity of the toner 22 (negative polarity in this embodiment) is applied to the primary transfer rollers 8 from a primary transfer bias power source (high voltage power source) serving as a primary transfer bias applying unit (not shown). The toner images on the surfaces of the respective photosensitive drums 1 are thereby sequentially primarily transferred onto the outer peripheral surface of the intermediate transfer belt 5 and superimposed.

At a position facing the secondary transfer opposing roller 52 on the outer peripheral surface side of the intermediate transfer belt 5, there is provided a secondary transfer roller 9 serving as a secondary transfer unit. The secondary transfer roller 9 is pressed against the secondary transfer opposing roller 52 with the intermediate transfer belt 5 therebetween by a biasing unit (not shown). A secondary transfer nip portion N2 where the outer peripheral surface of the intermediate transfer belt 5 is in contact with the secondary transfer roller 9 is thereby formed.

On the other hand, recording materials 12 accommodated in a feeding cassette 24 are fed out by a feeding roller 25, separated by a separating member 26, and fed one by one. Thereafter, the recording material 12 is nipped and conveyed by conveying rollers 27, and the leading end of the recording material 12 is brought into contact with the nip portion of stopped registration rollers 28, so that skew is corrected.

Thereafter, the registration rollers 28 rotate in accordance with the timing at which the toner image on the outer peripheral surface of the intermediate transfer belt 5 reaches the secondary transfer nip portion N2, and the recording material 12 is nipped and conveyed by the registration rollers 28, and is conveyed to the secondary transfer nip portion N2.

A secondary transfer bias of a polarity (positive polarity in this embodiment) opposite to the normal charging polarity of the toner 22 (negative polarity in this embodiment) is applied to the secondary transfer roller 9 from a secondary transfer bias power source (high voltage power source) serving as a secondary transfer bias applying unit (not shown). The toner image on the outer peripheral surface of the intermediate transfer belt 5 is thereby secondarily transferred to the recording material 12 at the secondary transfer nip portion N2. Each of the primary transfer rollers 8 and the secondary transfer roller 9 have the same configuration.

At the time of image formation, first, the surface of the photosensitive drum 1 is uniformly charged by the charging roller 2. Next, the uniformly charged surface of the photosensitive drum 1 is scanned and exposed by the laser light 3*a* corresponding to the image information emitted from the laser scanner unit 3, and an electrostatic latent image corresponding to the image information is formed on the surface of the photosensitive drum 1.

Next, the electrostatic latent image formed on the surface of the photosensitive drum 1 is developed as a toner image by the developing device 4. The toner image formed on the surface of the photosensitive drum 1 is primarily transferred onto the outer peripheral surface of the intermediate transfer belt 5 by the action of the primary transfer roller 8.

At the time of full-color image formation, the image forming process described above is sequentially performed in the image forming units 23 of the respective colors. Then, toner images of respective colors are sequentially primarily transferred onto the outer peripheral surface of the intermediate transfer belt 5 and superimposed. Thereafter, synchronized with the rotational movement of the intermediate transfer belt 5 in the direction of arrow B in FIG. 1, the recording material 12 is conveyed to the secondary transfer nip portion N2. The four color toner images on the outer peripheral surface of the intermediate transfer belt 5 are collectively secondarily transferred onto the recording material 12 by the action of the secondary transfer roller 9 which is in contact with the outer peripheral surface of the intermediate transfer belt 5 with the recording material 12 interposed therebetween.

The recording material 12 to which the toner image has been transferred is conveyed to a fixing device 10 serving as a fixing unit. The toner image is heated and pressurized in the process of being nipped and conveyed by a fixing roller and a pressure roller provided in the fixing device 10, and the toner image is thermally melted and thermally fixed to the recording material 12. Thereafter, the recording material 12 is nipped and conveyed by discharge rollers 29 and discharged onto a discharge tray 33 provided outside the image forming apparatus 100.

The primary-transfer remaining toner remaining on the surface of the photosensitive drum 1 after the primary transfer is removed by the cleaning blade 6 and recovered into the removed toner chamber 14*a*. On the other hand, the secondary-transfer remaining toner remaining on the outer peripheral surface of the intermediate transfer belt 5 after the secondary transfer is scraped off and removed by a cleaning blade 11*a* provided in a cleaning device 11 serving as a cleaning unit. The image forming apparatus 100 can also form a monochrome or multicolor image using desired one or some (not all) of the image forming units 23.

Process Cartridge

Figure 2:
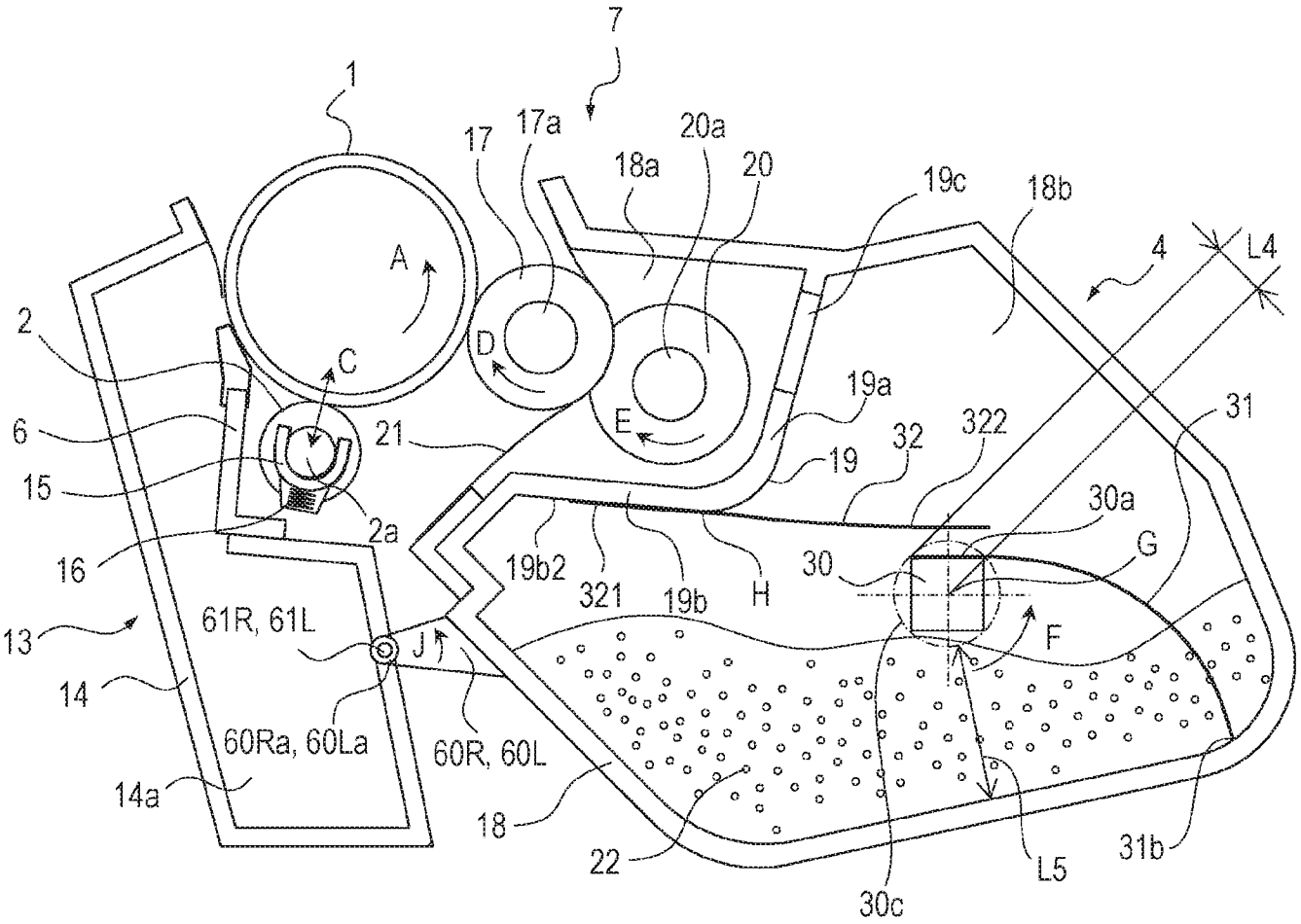
FIG. 2 is a sectional explanatory view showing the configuration of a process cartridge according to the present disclosure.

Next, the configuration of the process cartridge 7 attached to the image forming apparatus 100 will be described with reference to FIG. 2. FIG. 2 is a sectional explanatory view showing the configuration of the process cartridge 7 according to the present disclosure. In this embodiment, the configuration and operation of the process cartridge 7 of each color are substantially the same, except for the type (color) of the accommodated developer. The process cartridge 7 shown in FIG. 2 has a photosensitive member unit 13 including a photosensitive drum 1, and a developing device 4 serving as a developing unit including a developing roller 17. In the following description, unless otherwise specified, a section means a section in the direction perpendicular to the axial direction of a shaft member 30 described later. The section will be described as viewed from the axial direction of the shaft member 30. Photosensitive member unit The photosensitive member unit 13 shown in FIG. 2 has a cleaning frame 14 serving as a frame for supporting various elements. In the cleaning frame 14, a photosensitive drum 1 is rotatably provided via a bearing (not shown). The photosensitive drum 1 is rotationally driven by a motor serving as a driving unit (driving source) (not shown), and is rotationally driven in the direction of arrow A in FIG. 2 according to the image forming operation.

A charging roller 2 and a cleaning blade 6 are provided in the photosensitive member unit 13 so as to be in contact with the surface of the photosensitive drum 1. In the cleaning frame 14, there is provided a removed toner chamber 14*a* for accommodating residual toner removed from the surface of the photosensitive drum 1 by the cleaning blade 6. The residual toner removed from the surface of the photosensitive drum 1 by the cleaning blade 6 falls and is accommodated in the removed toner chamber 14*a*.

The cleaning frame 14 is provided with a bearing 15 for rotatably supporting the charging roller 2. The bearing 15 is provided so as to be movable in the direction of arrow C in FIG. 2 along a straight line passing through the rotation center of the charging roller 2 and the rotation center of the photosensitive drum 1. The rotating shaft 2*a* of the charging roller 2 is rotatably supported by the bearing 15. The bearing 15 is biased toward the photosensitive drum 1 by a pressure spring 16 serving as a biasing unit.

Developing Device

The developing device 4 serving as a developing unit has a developing frame 18 as a frame for supporting various elements in the developing device 4. In the developing device 4, a developing chamber 18*a* (first chamber) in which a developing roller 17 (developer bearing member) is provided, and an accommodating chamber 18*b* (second chamber) for accommodating toner 22 (developer) are formed by the developing frame 18. The longitudinal direction of the developing frame 18 is provided along the longitudinal direction of the developing roller 17 and the supply roller 20 (the direction of the rotating shafts 17*a* and 20*a*). In this embodiment, a portion of the developing device 4 including the developing frame 18, and a conveying sheet 32, an agitating member 31, and a shaft member 30 which will be described later is referred to as a developer container.

FIG. 2 shows a posture in which the process cartridge 7 is attached to the main body of the image forming apparatus 100. In the posture state shown in FIG. 2, the developing chamber 18*a* is disposed above the accommodating chamber 18*b* in the gravitational direction. The developing chamber 18*a* and the accommodating chamber 18*b* are separated by a partition wall 19 having a substantially L-shaped section.

Figure 3:
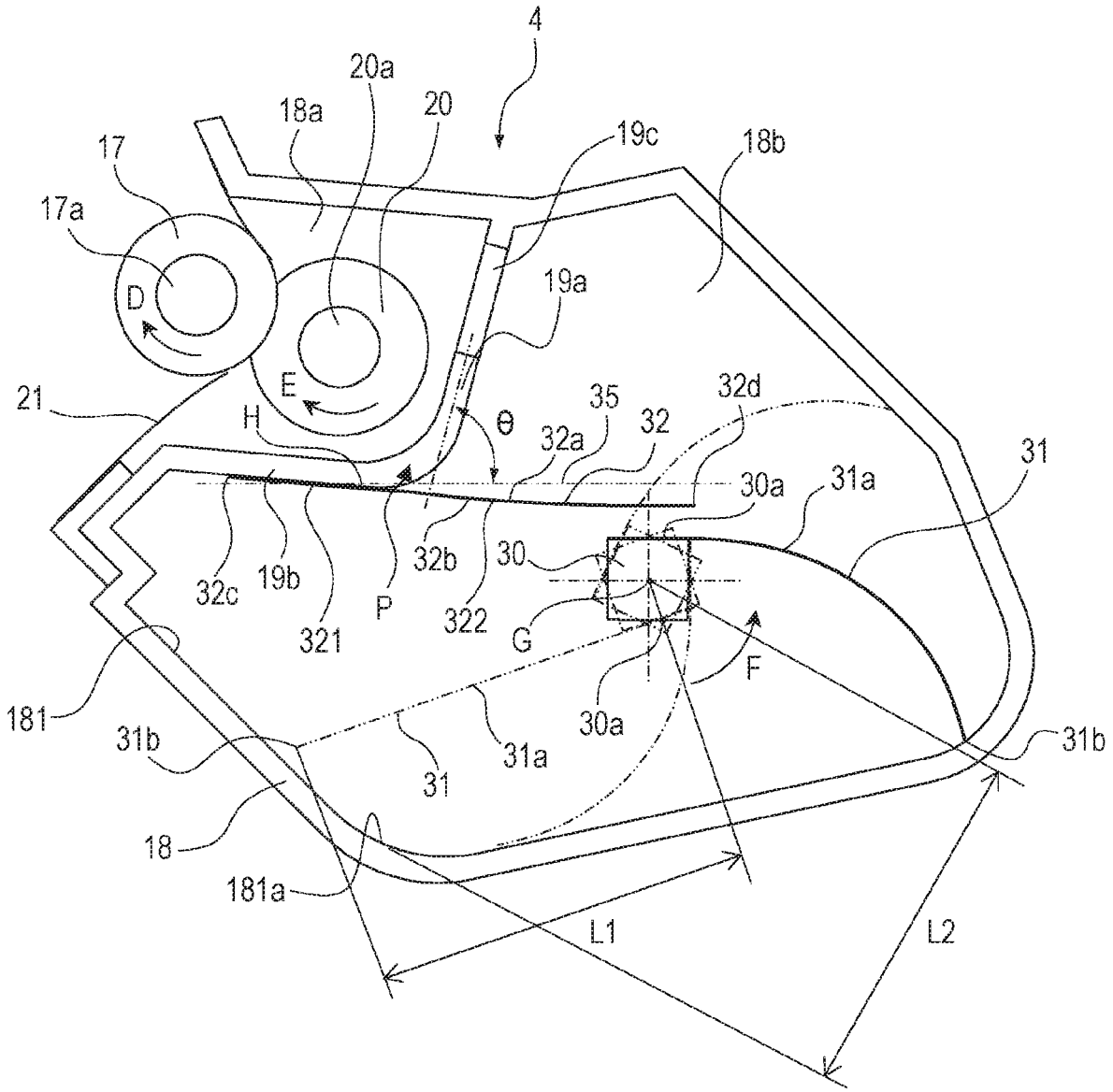
FIG. 3 is a sectional explanatory view showing the configuration of a conveying member for conveying the toner in the developing device according to the present disclosure.

The partition wall 19 has a side wall 19*a* provided at an angle θ (>0) with respect to the horizontal line 35 shown in FIG. 3, and a bottom wall 19*b* forming the bottom surface of the developing chamber 18*a*. The side wall 19*a* is provided with an opening 19*c* that is a through-hole connecting the developing chamber 18*a* and the accommodating chamber 18*b*. The developing frame 18 (frame) comprises the developing chamber 18*a* (first chamber), the accommodating chamber 18*b* (second chamber), and the partition wall 19.

A shaft member 30 rotatably supported by the developing frame 18 is provided in the accommodating chamber 18*b* (inside the accommodating chamber or inside the second chamber). The shaft member 30 is provided with an agitating member 31 having flexibility for agitating the toner 22 (developer) in the accommodating chamber 18*b* (inside the accommodating chamber or inside the second chamber). As shown in FIG. 2, the agitating member 31 is attached to an attachment portion 30*a* of the shaft member 30. The agitating member 31 rotates about the shaft member 30 in the direction of arrow F in FIG. 2.

Conveying Member

A conveying sheet 32 serving as a conveying member having flexibility for conveying the toner 22 (developer) is provided gravitationally below (below in FIG. 2) the opening 19*c* provided in the side wall 19*a*. One end in a direction perpendicular to the direction of the axis of rotation of the shaft member 30 (left-right direction in FIG. 2) of the conveying sheet 32 (conveying member) is fixed to an accommodating chamber surface 19*b*2 that is the lower surface of the bottom wall 19*b* which is a frame forming the accommodating chamber 18*b*. This portion is referred to as a fixed portion 321. That is, the fixed portion 321 is a portion fixed to the inner wall of the developing frame 18 forming the accommodating chamber 18*b*. In this embodiment, the bottom wall 19*b* of the partition wall 19 is a part of the inner wall forming the accommodation chamber 18*b*. The conveying sheet 32 may be fixed to a portion other than the bottom wall 19*b*. The other end of the conveying sheet 32 is a movable free portion (displacement portion) 322.

The agitating member 31, which rotates integrally with the shaft member 30 in the direction of arrow F in FIG. 2, and the conveying sheet 32, the fixed portion 321 of which is fixed to and supported by the accommodating chamber surface 19*b*2 that is the lower surface of the bottom wall 19*b*, cooperate to convey the toner 22 from the accommodating chamber 18*b* into the developing chamber 18*a*.

In the side wall 19*a* of the partition wall 19, there is provided an opening 19*c* that is located gravitationally above (above in FIG. 2) the shaft member 30 and that is a through-hole connecting the developing chamber 18*a* with the accommodating chamber 18*b*. In other words, in the gravitational direction, the shaft member 30 is disposed below the opening 19*c*. The opening 19*c* is provided above the bottom wall 19*b*. As a result, the toner 22 conveyed into the developing chamber 18*a* from the accommodating chamber 18*b* through the opening 19*c* can be prevented from returning to the accommodating chamber 18*b* through the opening 19*c*.

As shown in FIG. 2, in a posture in which the process cartridge 7 is attached to the main body of the image forming apparatus 100, the opening 19*c* connecting the developing chamber 18*a* and the accommodating chamber 18*b* is provided gravitationally above the accommodating chamber 18*b*. In the developing chamber 18*a*, there is provided a developing roller 17 serving as a developer bearing member that is in contact with the surface of the photosensitive drum 1 and rotates in the direction of arrow D in FIG. 2. The developing roller 17 and the photosensitive drum 1 are rotated such that the surfaces of the developing roller 17 and the photosensitive drum 1 move in the same direction (upward direction in FIG. 2 in this embodiment) in the facing portion (contact portion).

In this embodiment, the developing roller 17 is provided in contact with the surface of the photosensitive drum 1. Alternatively, the developing roller 17 may be disposed close to the surface of the photosensitive drum 1 with a predetermined gap therebetween. In the developing chamber 18*a*, there is provided a supply roller 20 serving as a developer supply member rotating in the direction of arrow E in FIG. 2. The supply roller 20 is in contact with the surface of the developing roller 17. In this embodiment, the supply roller 20 and the developing roller 17 are rotated such that the surfaces of the supply roller 20 and the developing roller 17 move in opposite directions in the facing portion (contact portion).

The supply roller 20 supplies the toner 22 in the developing chamber 18*a* onto the surface of the developing roller 17. The toner 22 remaining on the surface of the developing roller 17 without being used for development is stripped from the surface of the developing roller 17 and recovered to the developing chamber 18*a*. Both ends of the rotating shafts 17*a* and 20*a* of the developing roller 17 and the supply roller 20 are rotatably supported by bearings (not shown) provided in the developing frame 18.

A developing blade 21 serving as a developer regulating member for regulating the layer thickness of the toner 22 on the surface of the developing roller 17 supplied by the supply roller 20 is supported by the developing frame 18 of the developing device 4. The developing blade 21 makes contact with the surface of the developing roller 17.

A shaft member 30 rotatably supported by the developing frame 18 is provided in the accommodating chamber 18*b*. A rotational driving force of a motor serving as a driving unit (driving source) (not shown) provided in the image forming apparatus 100 is transmitted to the shaft member 30, and the shaft member 30 is rotationally driven in the direction of arrow F in FIG. 2 about the rotation center (rotational axis) G.

The shaft member 30 is provided across the entire longitudinal direction of the accommodating chamber 18*b* in a direction substantially parallel to the longitudinal direction (rotational axis direction) of the photosensitive drum 1, the developing roller 17, and the supply roller 20. One end of the agitating member 31 having flexibility is supported by the shaft member 30. One end of the agitating member 31 in a direction (rotational radius direction, widthwise direction) substantially perpendicular to the longitudinal direction of the shaft member 30 (the axial direction of the shaft member 30) is supported by the shaft member 30.

Figure 6B:
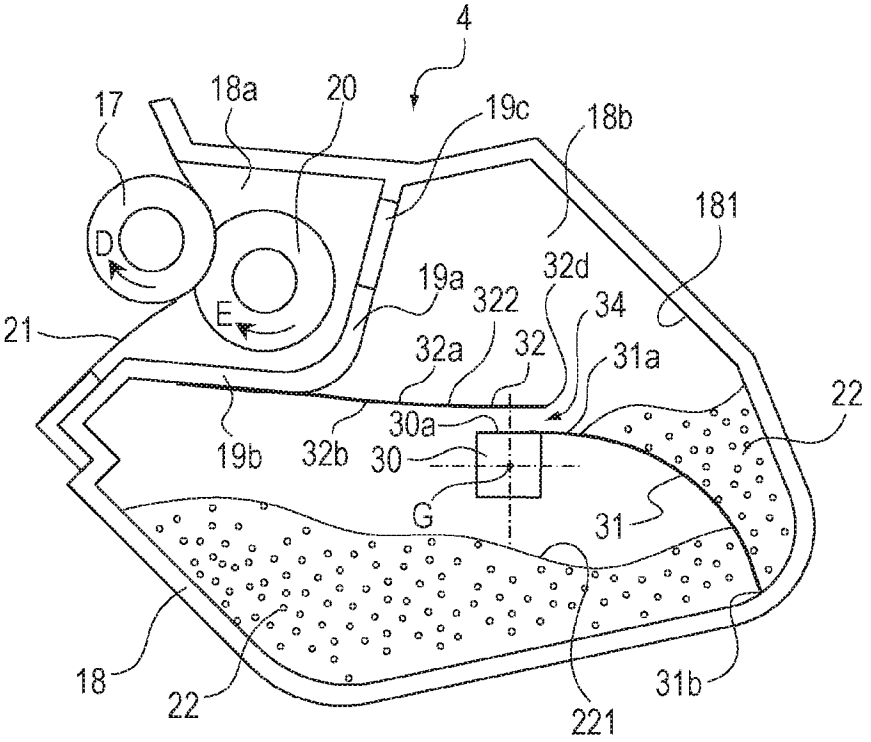
FIGS. 6A and 6B are sectional explanatory views showing the toner conveying operation in the toner accommodating chamber.
Figure 7B:
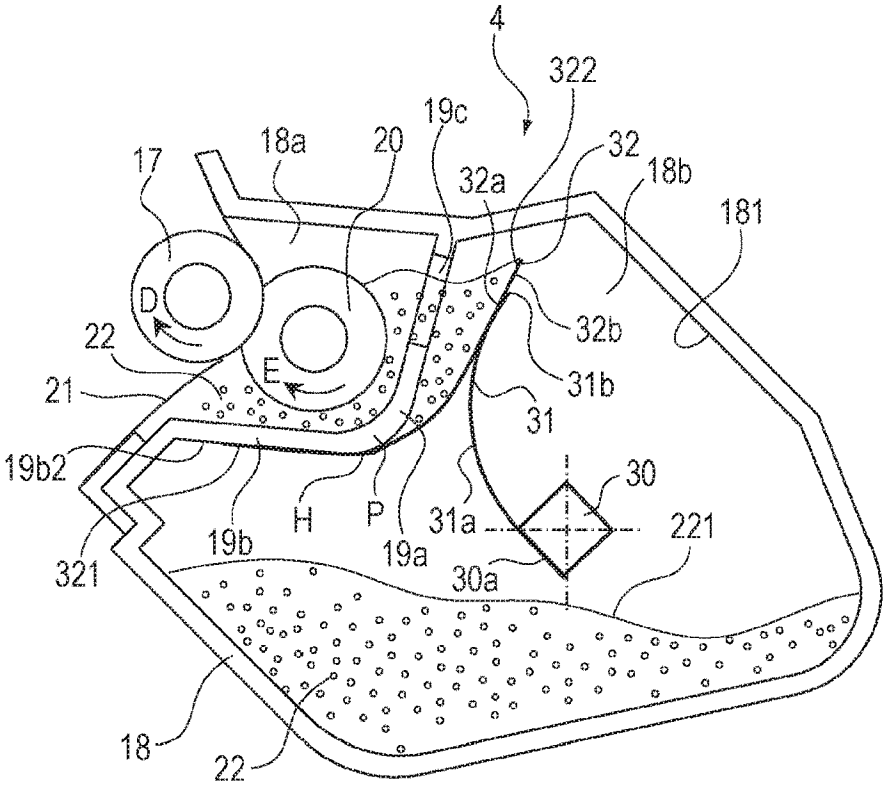
FIGS. 7A and 7B are sectional explanatory views showing the toner conveying operation in the toner accommodating chamber.
Figure 7A:
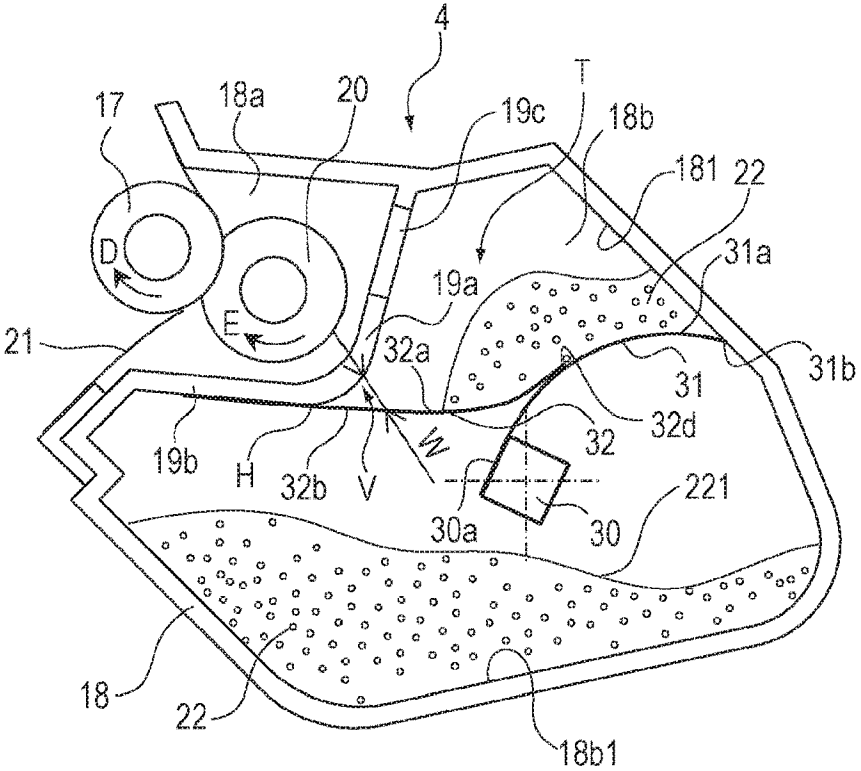

The agitating member 31 rotates in the direction of arrow F in FIG. 2 about the shaft member 30, thereby agitating the toner 22 accommodated in the accommodating chamber 18*b*. The toner 22 scooped up by the agitating surface 31*a* of the agitating member 31 as shown in FIG. 6B is delivered onto the conveying surface 32*a* of the conveying sheet 32 as shown in FIG. 7A. As shown in FIG. 7B, due to the rotation of the agitating member 31, the agitating member 31 pushes and rotates the conveying sheet 32 in the counterclockwise direction in FIG. 7B about the boundary point H between the fixed portion 321 fixed to the accommodating chamber surface 19*b*2 of the bottom wall 19*b* and the displacement portion 322. The toner 22 on the conveying surface 32*a* of the conveying sheet 32 is thereby conveyed through the opening 19*c* into the developing chamber 18*a*.

The fixed portion 321 at one end of the conveying sheet 32 having flexibility is fixed to and supported by the accommodating chamber surface 19*b*2 which is the lower surface of the bottom wall 19*b* of the developing chamber 18*a* on the accommodating chamber 18*b* side. As a result, the fixed portion 321 at one end of the conveying sheet 32 in the direction (widthwise direction) substantially perpendicular to the longitudinal direction of the side wall 19*a* is fixed to the accommodating chamber surface 19*b*2 which is the lower surface of the bottom wall 19*b* of the developing chamber 18*a*. The conveying sheet 32 is supported in a cantilever manner by its own rigidity so that the displacement portion 322 at the other end is movable.

As shown in FIG. 7A, the toner 22 conveyed by the agitating member 31 is delivered to the conveying sheet 32. Thereafter, as shown in FIG. 7B, the conveying sheet 32 is deformed toward the opening 19*c* by the rotation of the agitating member 31. The toner 22 is thereby conveyed through the opening 19*c* into the developing chamber 18*a*.

As shown in FIG. 2, a pair of developing side plates 60R and 60L are provided at both ends in the longitudinal direction of the developing frame 18. Holes 60Ra and 60La are provided at one end portions of the developing side plates 60R and 60L. On the other hand, a pair of shafts 61R and 61L are provided at both ends in the longitudinal direction of the cleaning frame 14. The shafts 61R and 61L provided in the cleaning frame 14 are slidably inserted into the holes 60Ra and 60La provided in the developing frame 18. As a result, the developing frame 18 is coupled swingably about the shafts 61R and 61L provided in the cleaning frame 14.

At the time of image formation, the developing device 4 is biased by a biasing unit (not shown) to rotate about the shafts 61R and 61L in the direction of arrow J in FIG. 2. The developing roller 17 provided in the developing device 4 is thereby brought into contact with the surface of the photosensitive drum 1 provided in the photosensitive body unit 13.

Conveying Member

Next, the configuration of the conveying member in the developing device 4 will be described with reference to FIGS. 2 and 3. FIG. 3 is a sectional explanatory view showing the configuration of a conveying member for conveying the toner 22 in the developing device 4 according to the present disclosure. In the configuration of the developing device 4 serving as a developing unit or the process cartridge 7 which will be described below, the vertical direction and the horizontal direction are the same as those in the normal use state in which the process cartridge 7 is attached to the main body of the image forming apparatus 100. The normal use state of the developing device 4 or the process cartridge 7 is a state in which the developing device 4 or the process cartridge 7 is properly attached to the appropriately arranged main body of the image forming apparatus 100 and is ready for image forming operation.

As shown in FIG. 3, the developing chamber 18*a* and the accommodating chamber 18*b* formed by the developing frame 18 are separated by the partition wall 19 having the side wall 19*a* and the bottom wall 19*b*, and communicate with each other through the opening 19*c* provided in the side wall 19*a*. The opening 19*c* can extend across the entire longitudinal direction along the rotating shaft 17*a* of the developing roller 17 in the developing device 4, but pillars (ribs) may be provided in the longitudinal direction of the opening 19*c* to the extent that the supply of the toner 22 is not disturbed.

The angle θ formed between the side wall 19*a* provided with the opening 19*c* and the horizontal line 35 in the horizontal direction (left-right direction in FIG. 3) is set as follows. Consider the direction in which the conveying sheet 32 (conveying member) is deformed by the agitating member 31. That is, consider the direction in which the displacement portion 322 of the conveying sheet 32 is pushed up by the agitating member 31 rotating about the shaft member 30, so that the displacement portion 322 is bent counterclockwise in FIG. 3 about the boundary point H between the fixed portion 321 and the displacement portion 322 of the conveying sheet 32. The angle θ is set to a positive value (θ>0) in that direction.

The angle θ of the side wall 19*a* with respect to the horizontal line 35 is configured to be larger than the angle of repose of the toner 22. The angle of repose is the angle of the slope where the toner 22 maintains stability without spontaneous slump.

As a result, the toner 22 conveyed from the accommodating chamber 18*b* into the developing chamber 18*a* can move in the direction of the developing roller 17 due to its own weight. The angle θ of the side wall 19*a* with respect to the horizontal line 35 is preferably 30° to 150°. Although the angle θ is not limited to this range, if the angle is smaller than this range, depending on the fluidity of the toner 22, there is a possibility that the toner 22 can stagnate on the developing chamber 18*a* side surface of the side wall 19*a*.

The lower portion of the side wall 19*a* is connected to the bottom wall 19*b* at the connecting portion P. The bottom wall 19*b* is provided integrally with the developing frame 18 across the entire longitudinal direction of the developing roller 17 so as to prevent the toner 22 from returning to the accommodating chamber 18*b* in order to efficiently supply the toner 22 conveyed into the developing chamber 18*a* to the developing roller 17.

A shaft member 30 rotatably supported by the developing frame 18 is provided in the accommodating chamber 18*b*. A rotational driving force of a motor serving as a driving unit (driving source) (not shown) provided in the image forming apparatus 100 is transmitted to the shaft member 30, and the shaft member 30 is rotationally driven in the direction of arrow F in FIG. 3.

The shaft member 30 is provided across the entire longitudinal direction of the accommodating chamber 18*b* in a direction substantially parallel to the longitudinal direction (rotational axis direction) of the photosensitive drum 1, the developing roller 17, and the supply roller 20. One end of the agitating member 31 having flexibility is fixed to the shaft member 30. One end of the agitating member 31 in a direction (rotational radius direction, widthwise direction) substantially perpendicular to the longitudinal direction of the shaft member 30 is fixed to the shaft member 30.

The agitating member 31 conveys the toner between the shaft member 30 and the inner wall of the developing frame 18 forming the accommodating chamber 18*b*. Therefore, in order for the agitating member 31 to convey more toner, it is desirable that the distance between the agitating member 31 and the rotation center (rotational axis) G of the shaft member 30 is short and the distance between the shaft member 30 and the inner wall of the developing frame 18 forming the accommodating chamber 18*b* is long.

As shown in FIGS. 2 and 3, in this embodiment, in the direction perpendicular to the rotational axis of the shaft member 30, the distance L4 between the attachment portion 30*a* and the rotation center (rotational axis) G of the shaft member 30 is shorter than the shortest distance L5 between the inner wall of the developing frame 18 forming the accommodating chamber 18*b* and the attachment portion 30*a*. The shortest distance is the minimum value of the distance between the inner wall of the developing frame 18 forming the accommodating chamber 18*b* and the attachment portion 30*a* during one revolution of the shaft member 30. The distance L4 shown in FIG. 2 is the longest distance between the attachment portion 30*a*, which is one side of the shaft member 30 having a square cross-section, and the rotation center G (rotational axis) of the shaft member 30. On the other hand, the shortest distance L5 is the shortest distance between the rotation locus 30*c* of a corner of the shaft member 30 and the inner wall of the developing frame 18 forming the accommodating chamber 18*b*. The length of the agitating member 31 is made longer than the diameter of rotation of the attachment portion 30*a* (a diameter of the rotation locus 30*c*).

The agitating member 31 has an agitating surface 31*a* that is a downstream side surface in the rotation direction indicated by arrow F in FIG. 3 of the shaft member 30. The agitating member 31 can be made of a flexible resin sheet such as a polyester film, a polyphenylene sulfide film, or a polycarbonate film. The thickness of the agitating member 31 is preferably 50 μm to 250 μm. However, the material and thickness of the agitating member 31 need not be limited to these.

Consider the length L1 from the rotation center G of the shaft member 30 to the distal end portion 31*b* of the agitating member 31. The length L1 corresponds to the maximum value of the radius of rotation of the agitating member 31 in the natural state in which the agitating member 31 is not deformed.

Also consider the linear distance L2 from the rotation center G of the shaft member 30 to an inner wall portion 181*a* that is the gravitationally lowermost portion of the inner wall 181 of the accommodating chamber 18*b*. In this embodiment, the length L1 and the linear distance L2 satisfy the relationship represented by the following expression 1:

$$L1>L2.$$

Figure 4:
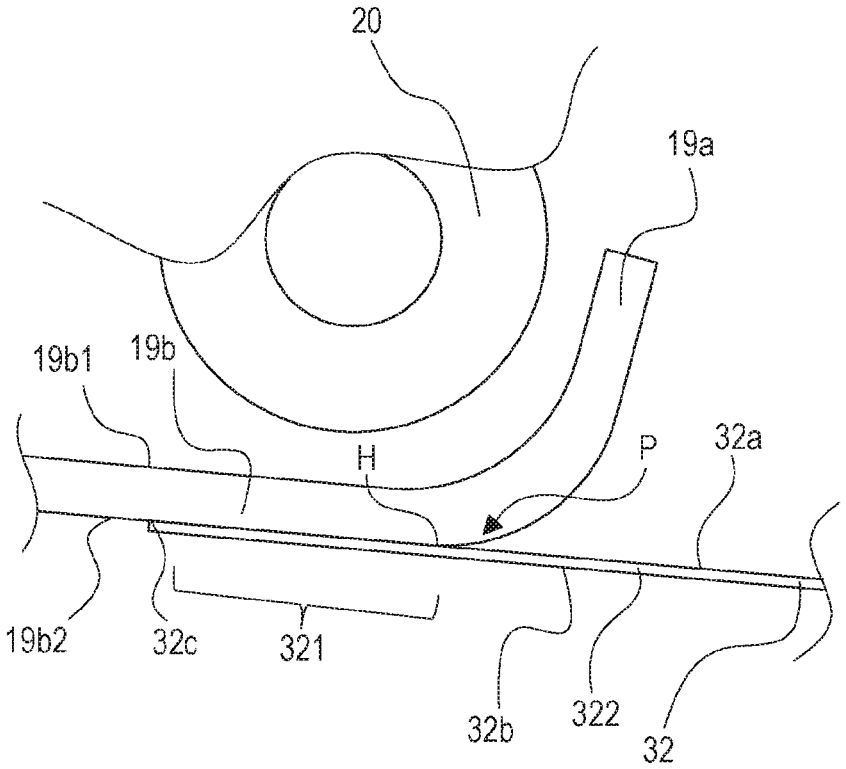
FIG. 4 is a sectional explanatory view showing the configuration of a conveying sheet whose one end portion is fixed to the lower surface of the bottom wall of a developing chamber in a toner accommodating chamber.

In the accommodating chamber 18*b*, one end of the conveying sheet 32 having flexibility is fixed to the accommodating chamber surface 19*b*2 which is the lower surface of the bottom wall 19*b* of the developing chamber 18*a*. FIG. 4 is a sectional explanatory view showing the configuration of the conveying sheet 32 whose one end is fixed to the accommodating chamber surface 19*b*2 which is the lower surface of the bottom wall 19*b* of the developing chamber 18*a* in the accommodating chamber 18*b*. As shown in FIG. 4, the bottom wall 19*b* of the developing chamber 18*a* has a developing chamber surface 19*b*1 on the developing chamber 18*a* side and an accommodating chamber surface 19*b*2 on the accommodating chamber 18*b* side.

As with the agitating member 31 shown in FIG. 3, the conveying sheet 32 is provided across substantially the entire longitudinal direction (direction of the rotating shaft 17*a*) of the developing roller 17. The conveying sheet 32 has a conveying surface 32*a* opposed to the opening 19*c* provided in the side wall 19*a* shown in FIG. 3 and a contact surface 32*b* opposed to the shaft member 30.

The fixed portion 321 provided at one end (the left end in FIG. 4) in a direction (left-right direction in FIG. 4) substantially perpendicular to the longitudinal direction of the conveying sheet 32 is fixed to the accommodating chamber surface 19*b*2 which is the lower surface of the bottom wall 19*b* of the developing chamber 18*a*. In the fixed portion 321, it is desirable that the accommodating chamber surface 19*b*2 of the bottom wall 19*b* and the conveying surface 32*a* of the conveying sheet 32 be bonded to each other from the fixed end portion 32*c* to the connecting portion P between the side wall 19*a* and the bottom wall 19*b* across substantially the entire longitudinal direction of the bottom wall 19*b*. In this embodiment, the fixed portion 321 of the conveying sheet 32 is bonded to the accommodating chamber surface 19*b*2, which is the lower surface of the bottom wall 19*b*, with a double-sided adhesive tape (not shown). Besides, adhesion, heat bonding, welding or the like may be used, and there is no need to limit it to this. Further, as shown in FIG. 4, the surface of the conveying sheet 32 on the side opposite to the surface with which the agitating member 31 comes into contact is fixed to the bottom wall 19*b* (accommodating chamber surface 19*b*2). Therefore, when the conveying sheet 32 is deformed by the agitating member 31, the force for peeling the fixed portion 321 from the developing frame 18 can be prevented from acting.

Figure 5:
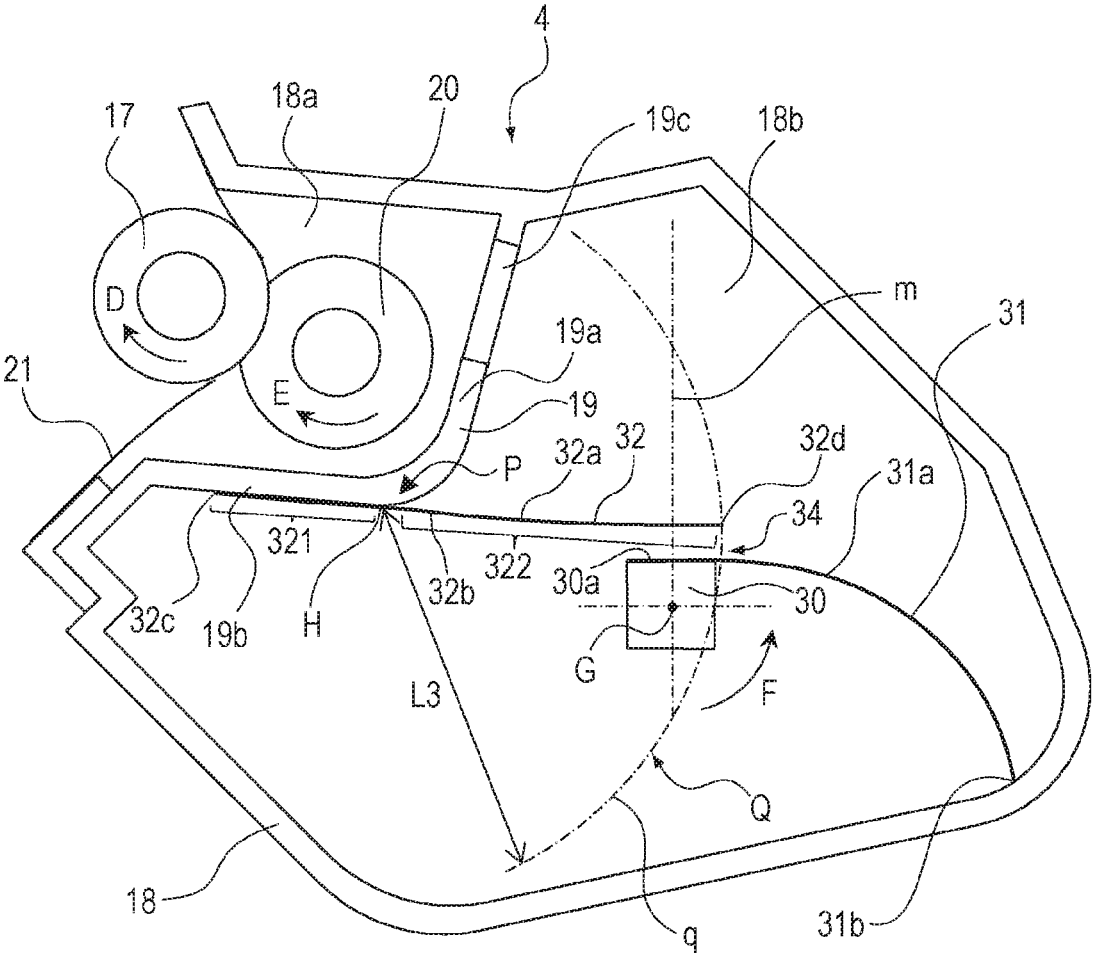
FIG. 5 is a sectional explanatory view showing the configuration of the conveying sheet and the shaft member.

Next, the configuration of the conveying sheet 32 and the shaft member 30 will be described with reference to FIG. 5. FIG. 5 is a sectional explanatory view showing the configuration of the conveying sheet 32 and the shaft member 30 as seen from the axial direction of the shaft member 30. The opposite side of the conveying sheet 32 shown in FIG. 5 from the fixed end portion 32*c* is referred to as the free end portion 32*d*. The region other than the fixed portion 321 including the free end portion 32*d* is configured to be movable as a displacement portion 322.

The rotation center G of the shaft member 30 is provided within the region Q of the radius of rotation of the displacement portion 322 (within the region of the radius of rotation) centered at the boundary point H between the fixed portion 321 and the displacement portion 322 of the conveying sheet 32 corresponding to the connecting portion P between the side wall 19*a* and the bottom wall 19*b*. The radius of rotation of the displacement portion 322 has the length L3 from the boundary point H to the free end portion 32*d*. The region Q of the radius of rotation described above coincides with an imaginary circle q centered at the boundary point H and passing through the distal end (free end portion 32*d*) of the displacement portion 322. Therefore, the rotation center G of the shaft member 30 is disposed inside (in the inside region of) the above-described imaginary circle q.

In a state in which the conveying sheet 32 does not receive an external force (a state in which the conveying sheet 32 is not contact with the agitating member 31), the free end portion 32*d* is provided on the side opposite to the boundary point H with respect to a vertical line m passing through the rotation center G of the shaft member 30. The boundary point H is the boundary between the fixed portion 321 which cannot be deformed when the conveying sheet 32 receives an external force and the displacement portion 322 which is deformable.

The conveying sheet 32 can be suitably made of a flexible resin sheet such as a polyester film, a polyphenylene sulfide film, or a polycarbonate film. Both of the conveying sheet 32 and the agitating member 31 are made of a resin sheet. Therefore, they have the property of being easily bent by stress caused by external force.

The conveying sheet 32 can have the property of being more flexible than the agitating member 31. In the case of the same material, the thickness of the conveying sheet 32 is made thinner than the thickness of the agitating member 31. In the case of different materials, it is desirable to set the rigidity of the conveying sheet 32 to be lower than the rigidity of the agitating member 31. The thickness of the conveying sheet 32 is preferably 50 μm to 250 μm. It is desirable that the conveying sheet 32 not sag in the middle due to its own weight or the weight of the toner 22. The conveying sheet 32 can also be made of materials other than a resin material.

Toner Conveying Operation

Next, with reference to FIGS. 6A, 6B, 7A, 7B, and 10, the operation of conveying the toner 22 by the agitating member 31 and the conveying sheet 32 will be described. FIGS. 6A, 6B, 7A, 7B, and 10 are sectional explanatory views showing the toner conveying operation in the accommodating chamber 18*b*. The agitating member 31 shown in FIG. 6A satisfies the relationship of the above-mentioned equation 1. Therefore, the agitating member 31 can come into contact with the inner wall of the developing frame 18 in the accommodating chamber 18*b* (in the accommodating chamber). The shaft member 30 rotates about the rotation center G in the counterclockwise direction in FIG. 6A. Along with this, the agitating member 31 slides on the inner wall 181 of the accommodating chamber 18*b* while rotating integrally with the shaft member 30, and bends as the agitating member 31 rotates.

Figure 10:
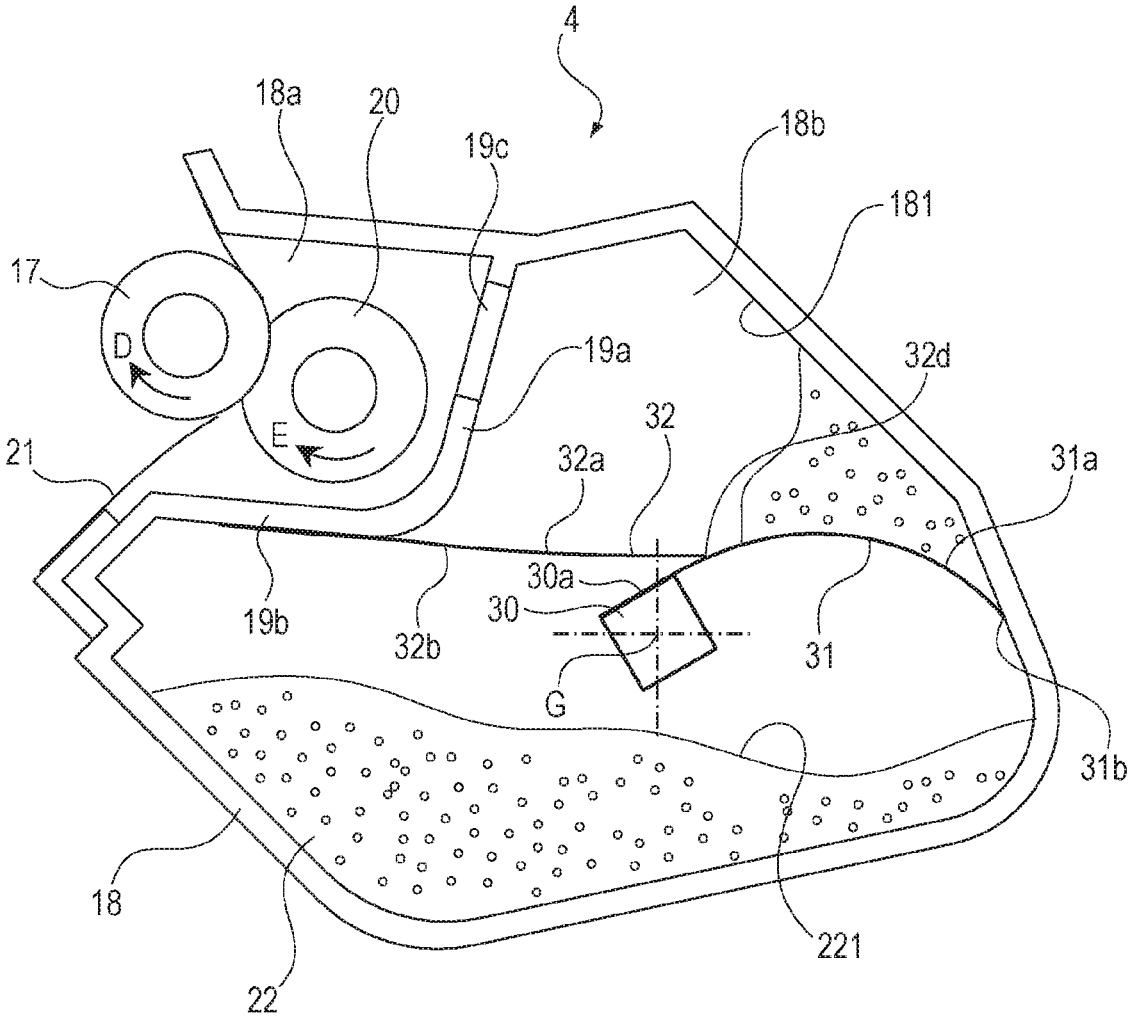
FIG. 10 is a sectional explanatory views showing the toner conveying operation in the toner accommodating chamber.

Then, as shown in FIG. 6B, the agitating member 31 further rotates to scoop up the toner 22 accommodated in the accommodating chamber 18*b* onto the agitating surface 31*a* of the agitating member 31. Then, as shown in FIG. 10, the agitating surface 31*a* comes into contact with the free end portion 32*d* of the conveying sheet 32. At this time, a part of the agitating member 31 that is nearer to the free end (distal end) than the part supported by the shaft member 30 comes into contact with the conveying sheet 32. Next, as shown in FIG. 7A, the agitating surface 31*a* of the agitating member 31 is brought into contact with at least one of the free end portion 32*d* and the contact surface 32*b* of the conveying sheet 32 by rotation of the agitating member 31 to temporarily form a conveying space T that is a closed space in the accommodating chamber 18*b*.

The conveying space T shown in FIG. 7A is formed as a closed space by the inner wall 181 of the developing frame 18, the side wall 19*a*, the conveying surface 32*a* of the conveying sheet 32, and the agitating surface 31*a* of the agitating member 31. By forming the conveying space T in the upper part of the accommodating chamber 18*b*, the toner 22 can be held above the deposition surface 221 of the toner 22 accommodated on the bottom surface 18*b*1 in the accommodating chamber 18*b*.

Further, the toner 22 scooped up on the agitating surface 31*a* of the agitating member 31 can be prevented from falling into the accommodating chamber 18*b*, and the toner 22 can be held on the agitating surface 31*a* of the agitating member 31. At this time, the displacement portion 322 of the conveying sheet 32 deforms upward in FIG. 7A while sliding on the agitation surface 31*a* of the agitating member 31 rotating integrally with the shaft member 30. The toner 22 on the agitating surface 31*a* of the agitating member 31 is thereby gradually delivered onto the conveying surface 32*a* of the conveying sheet 32.

Further, as the agitating member 31 rotates, as shown in FIG. 7B, the displacement portion 322 of the conveying sheet 32 is urged and pushed upward by the agitating member 31, and deformed toward the opening 19*c* provided in the side wall 19*a*. By this deformation, the toner 22 on the conveying surface 32*a* of the conveying sheet 32 is conveyed toward the opening 19*c*, and is supplied into the developing chamber 18*a* through the opening 19*c*.

That is, the displacement portion 322 can move relative to the opening 19*c*. The displacement portion 322 is located between the opening 19*c* and the shaft member 30. The displacement portion 322 can move from the position gravitationally below the opening 19*c* toward the opening 19*c* by coming into contacting with the agitating member 31.

As shown in FIG. 7A, a wedge-shaped portion V having a V-shaped section is formed between the side wall 19*a* and the conveying surface 32*a* of the conveying sheet 32. As shown in FIG. 7B, due to the rotation of the agitating member 31 rotating integrally with the shaft member 30, the displacement portion 322 of the conveying sheet 32 is lifted by the agitating member 31. At this time, the wedge-shaped portion V is deformed in a direction to contract the width W. The toner 22 accumulated in the wedge-shaped portion V is thereby pushed up toward the opening 19*c* in the side wall 19*a*. The toner 22 is thereby conveyed through the opening 19*c* into the developing chamber 18*a*.

Thereafter, the agitating member 31 further rotates about the shaft member 30 in the counterclockwise direction in FIG. 7B. Then, the agitating member 31 passes through the connecting portion P between the side wall 19*a* and the bottom wall 19*b* and comes out of contact with the conveying sheet 32, and returns to the state shown in FIG. 6A. By repeating the conveying operation of the toner 22 shown in FIGS. 6A to 7B, the toner 22 in the accommodating chamber 18*b* can be stably supplied to the developing chamber 18*a*.

In this embodiment, as shown in FIG. 5, the rotation center G of the shaft member 30 is disposed within the region Q of the radius of rotation centered at the boundary point H between the fixed portion 321 and the displacement portion 322 of the conveying sheet 32 and having a radius equal to the length L3 of the displacement portion 322 (inside the above-described imaginary circle q).

In this embodiment, in order for the agitating member 31 to convey more toner, the distance between the agitating member 31 and the rotation center (rotational axis) G of the shaft member 30 is short. At this time, if the distance between the rotation center G and the conveying sheet 32 is long, the amount of toner falling from the agitating member 31 before the toner 22 is delivered to the conveying sheet 32 may increase.

On the other hand, when the rotation center G of the shaft member 30 is arranged as in this embodiment, the conveying sheet 32 and the agitating member 31 come into contact earlier than when the rotation center G of the shaft member 30 is outside the area Q of the radius of rotation (outside the imaginary circle q described above). That is, in the configuration of this embodiment, it is possible to shorten the time from when the agitating member 31 starts scooping up the toner 22 until the conveying sheet 32 and the agitating member 31 come into contact. In other words, it is possible to reduce the amount of toner falling from the gap between the conveying sheet 32 and the shaft member 30. Therefore, it is possible to deliver more toner 22 while enlarging the conveying space T and suppressing the falling of the toner 22.

Further, by arranging the rotation center G of the shaft member 30 as in this embodiment, the agitating member 31 rotating about the rotation center G of the shaft member 30 in the direction of arrow F in FIG. 5 can surely come into contact with the displacement portion 322 of the conveying sheet 32 and push it upward. Therefore, falling of the toner 22 scooped up by the agitating surface 31*a* of the agitating member 31 can be suppressed. As a result, the toner 22 scooped up by the agitating surface 31*a* of the agitating member 31 rotating about the rotation center G of the shaft member 30 in the direction of arrow F in FIG. 5 can be stably delivered onto the conveying surface 32*a* of the conveying sheet 32.

As shown in FIGS. 7A and 7B, in this embodiment, in a direction perpendicular to the rotational axis of the shaft member 30, the rotational axis of the shaft member 30 is located on the side of the distal end of the conveying sheet 32 with respect to the opening 19*c*. Further, while the conveying sheet 32 and the agitating member 31 are in contact, the attachment portion 30*a* is located on the side of the distal end of the conveying sheet 32 with respect to the opening 19*c*. By doing this, the agitating member 31 can easily move the conveying sheet 32 to the vicinity of the opening 19*c*.

Consider a case where the rotation center G of the shaft member 30 is outside the region Q of the radius of rotation (outside the imaginary circle q described above). In this case, depending on the position of the distal end of the conveying sheet 32 and the contact state of the agitating member 31, the conveying sheet 32 may be pushed down by the agitating member 31. That is, letting the direction in which the conveying sheet 32 is pushed up to supply the toner 22 through the opening 19*c* be referred to as the feeding direction, the conveying sheet 32 may be pushed down in the opposite direction to the feeding direction and may be peeled.

On the other hand, in the configuration of this embodiment, it is possible to move the displacement portion 322 of the conveying sheet 32 in the above-described feeding direction, and it is possible to suppress occurrence of peeling. Further, even when the conveying sheet 32 is lowered due to the weight of the toner 22 or the like, the conveying sheet 32 can be received by the shaft member 30, so that occurrence of the above-described peeling can be suppressed.

Figure 11:
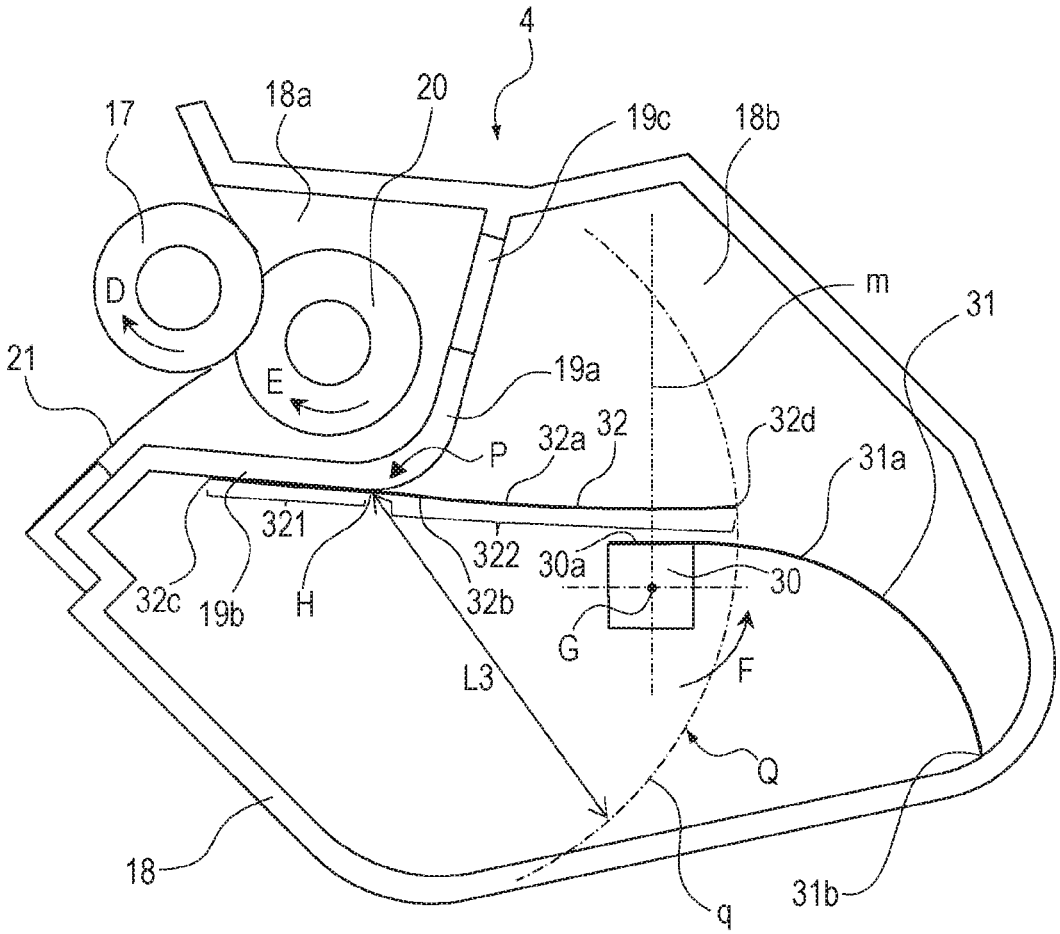
FIG. 11 is a sectional explanatory view showing an example of the arrangement of the conveying sheet and the shaft member according to the present disclosure.

Here, another arrangement of the conveying sheet 32 and the shaft member 30 will be described with reference to FIG. 11. FIG. 11 is a sectional explanatory view showing an example of the arrangement of the conveying sheet 32 and the shaft member 30 according to the present disclosure.

In the configuration shown in FIG. 5, the rotation center G of the shaft member 30 is disposed within the region Q of the radius of rotation centered at the boundary point H between the fixed portion 321 and the displacement portion 322 of the conveying sheet 32 and having a radius equal to the length L3 of the displacement portion 322 (inside the above-described imaginary circle q). On the other hand, in the configuration shown in FIG. 11, the whole of the shaft member 30 is disposed within the region Q of the radius of rotation (inside the above-described imaginary circle q). By doing this, it is possible to push up the displacement portion 322 of the conveyance sheet 32 more reliably.

It is possible to stably perform the conveying operation of the toner 22 shown in FIGS. 6A to 7B, so that it is possible to increase the amount of toner 22 supplied from the accommodating chamber 18*b* to the developing chamber 18*a* per rotation of the agitating member 31. As a result, the volume of the developing chamber 18*a* can be reduced, and the size of the developing device 4 can be reduced.

In this embodiment, first, as shown in FIG. 6B, the agitating member 31 rotates integrally with the shaft member 30 about the rotation center G of the shaft member 30 in the counterclockwise direction in FIG. 6B so that the toner 22 in the accommodating chamber 18*b* is scooped up onto the agitating surface 31*a* and accumulated. Thereafter, as shown in FIG. 7A, the agitating surface 31*a* of the agitating member 31 comes into contact with the lower surface of the displacement portion 322 of the conveying sheet 32 to form a conveying space T that is a closed space, and delivers the toner 22 on the agitating surface 31*a* of the agitating member 31 onto the conveying surface 32*a* of the conveying sheet 32.

As a result, by cooperation of the agitating member 31 and the conveying sheet 32, the toner 22 is prevented from falling into the accommodating chamber 18*b* while the toner 22 is being conveyed in the conveying space T, and the toner 22 can be stably conveyed. When the toner 22 in the accommodating chamber 18*b* is conveyed upward against gravity, a path through which the toner 22 being conveyed falls due to its own weight and returns to the accommodating chamber 18*b* is blocked. As a result, the toner 22 in the accommodating chamber 18*b* can be stably conveyed upward against gravity.

Modification

Figure 8:
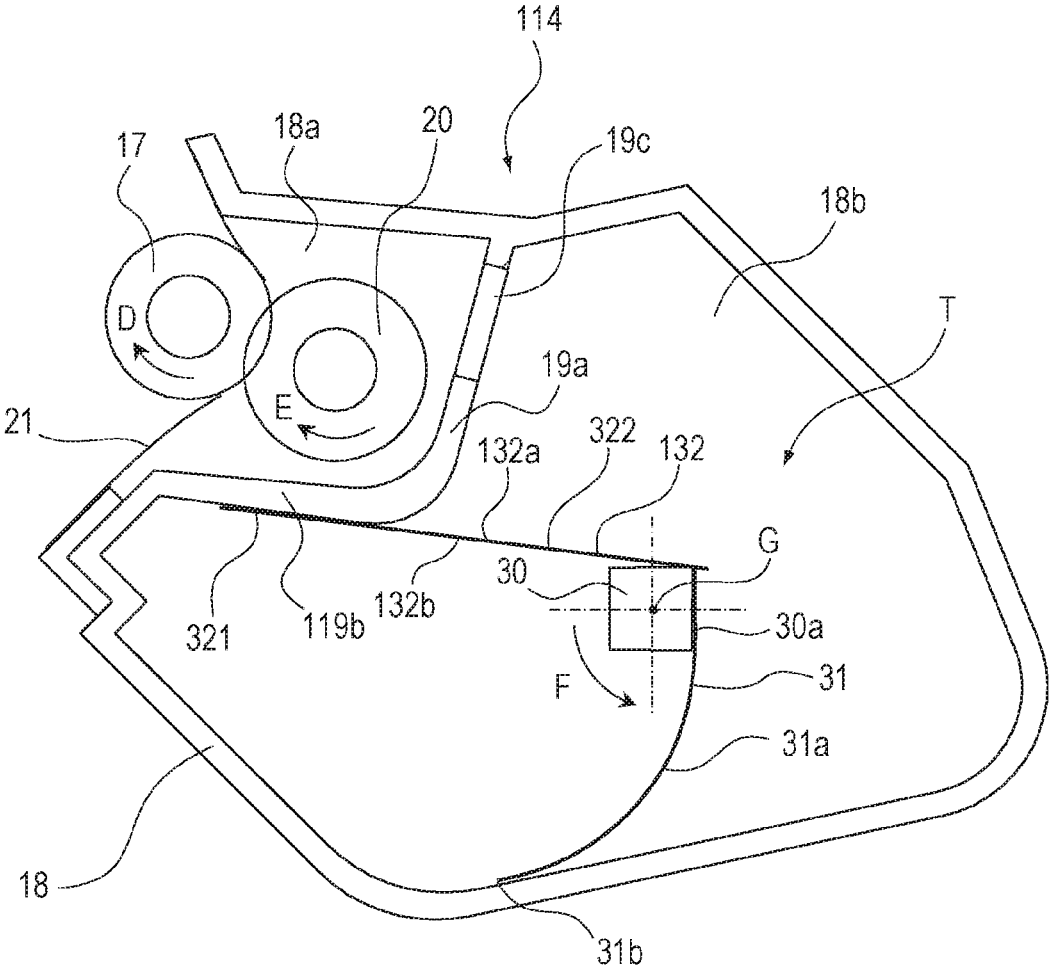
FIG. 8 is a sectional explanatory view showing the configuration of a modification of the developing device according to the present disclosure.

FIG. 8 is a sectional explanatory view showing the configuration of a modification of the developing device 114 according to the present disclosure. Consider a rotational phase in which the distal end portion 31*b* of the agitating member 31 is below the rotation center G of the shaft member 30 as in the developing device 114 of the modification shown in FIG. 8. At that time, the conveying sheet 132 is located gravitationally below (below in FIG. 8) the opening 19*c* provided in the side wall 19*a*. The conveying sheet 132 serving as a conveying member having flexibility for conveying the toner 22 (developer) can be brought into contact with the shaft member 30 or the agitating member 31 by at least one of own resilience and own weight of the conveying sheet 132.

According to the configuration of the developing device 114 of the modification shown in FIG. 8, the toner 22 scooped up by the agitating surface 31*a* of the agitating member 31 rotating integrally with the shaft member 30 in the direction of arrow F in FIG. 8 is delivered onto the conveying surface 132*a* of the conveying sheet 132. It is possible to form a conveying space T that is a closed space before that.

As a result, as shown in FIG. 6B, the toner 22 scooped up by the agitating surface 31*a* of the agitating member 31 rotating integrally with the shaft member 30 in the counterclockwise direction in FIG. 6B is delivered onto the conveying surface 32*a* of the conveying sheet 32. It is possible to further suppress falling of the toner 22 into the accommodating chamber 18*b* as compared with the case where a gap 34 is formed between the displacement portion 322 of the conveying sheet 32 and the shaft member 30 or the agitating member 31 before that. As a result, it is possible to further increase the amount of toner 22 supplied from the accommodating chamber 18*b* to the developing chamber 18*a* per rotation of the agitating member 31.

Figure 9:
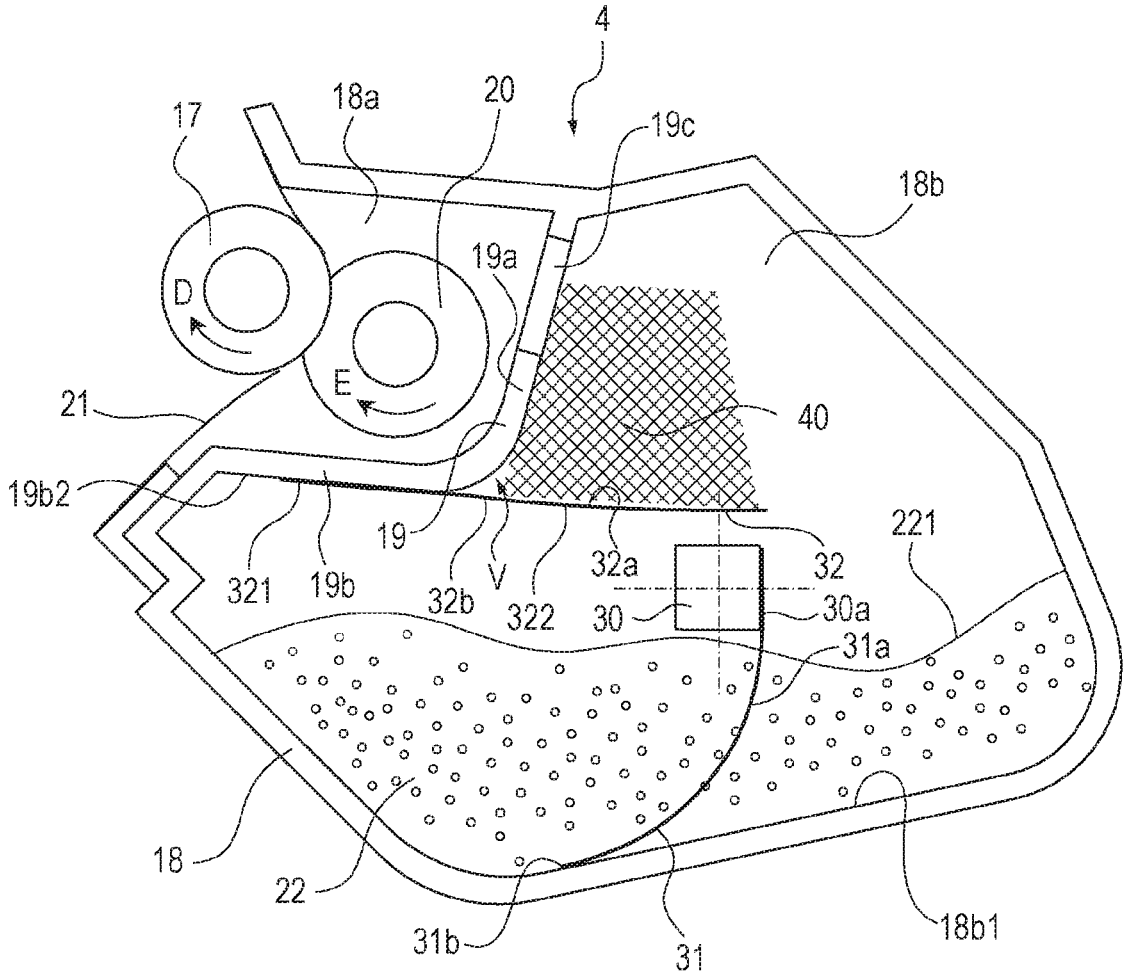
FIG. 9 is a sectional explanatory view showing the configuration of a space for temporarily storing the developer on the conveying sheet of the developing device according to the present disclosure.

FIG. 9 is a sectional explanatory view showing the configuration of a space 40 for temporarily storing the toner 22 (developer) on the conveying sheet 32 of the developing device 4 according to the present invention. In the developing device 4 shown in FIG. 9, the fixed portion 321 of the conveying sheet 32 is fixed to the accommodating chamber surface 19*b*2 of the bottom wall 19*b* provided below the opening 19*c* formed in the side wall 19*a*. On the other hand, the displacement portion 322 of the conveying sheet 32 is provided so as to be movable toward the inside of the accommodating chamber 18*b*. The conveying sheet 32 is made of a resin sheet having flexibility. Therefore, by appropriately selecting the thickness and the material of the conveying sheet 32, the rigidity of the conveying sheet 32 can be set high.

The conveying sheet 32 (conveying member) of this embodiment forms a space 40 for temporarily storing the toner 22 (developer) between the conveying sheet 32 (conveying member) and the side wall 19*a* (partition wall) provided with the opening 19*c*. A space 40 indicated by a cross-hatched portion in FIG. 9 in which the toner 22 can be temporarily deposited is formed on the conveying surface 32*a* of the conveying sheet 32. As shown in FIG. 7B, the displacement portion 322 of the conveying sheet 32 is pushed up by the agitating member 31 rotating integrally with the shaft member 30 in the counterclockwise direction in FIG. 7B. Thereafter, the toner 22 on the conveying surface 32*a* of the conveying sheet 32 is conveyed toward the opening 19*c* provided in the side wall 19*a*.

Figure 6A:
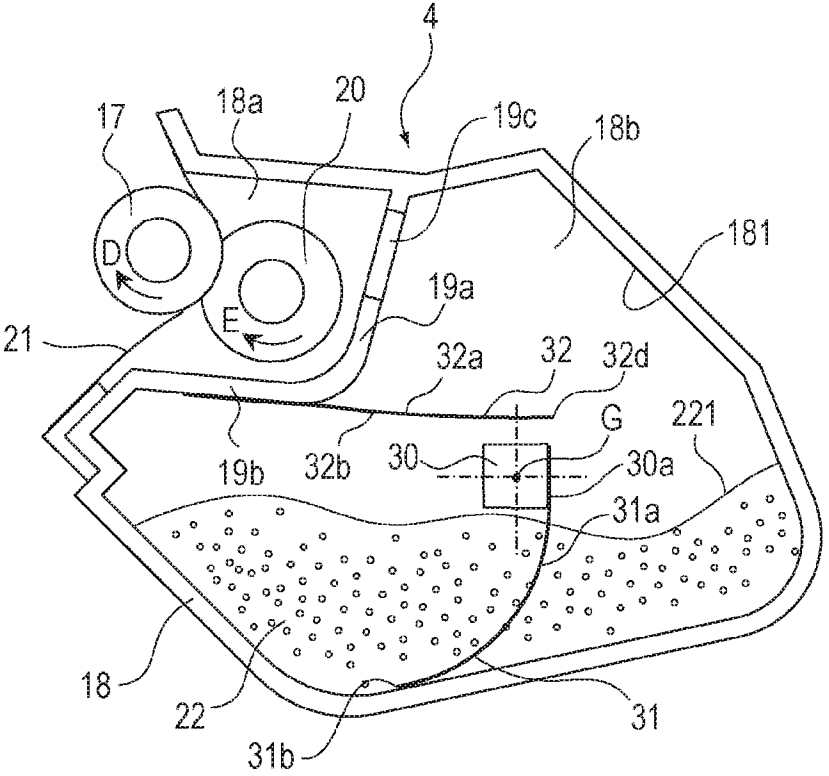

When the toner 22 is abundant in the developing chamber 18*a*, not all of the toner 22 on the agitating surface 31*a* of the agitating member 31 and on the conveying surface 32*a* of the conveying sheet 32 is conveyed into the developing chamber 18*a*. The agitating member 31 rotating integrally with the shaft member 30 in the counterclockwise direction in FIG. 7B passes through the connecting portion P between the side wall 19*a* and the bottom wall 19*b*, and as shown in FIG. 6A, the agitating member 31 comes out of contact with the conveying sheet 32. Thereafter, a certain amount of toner 22 falls from the conveying surface 32*a* of the conveying sheet 32 due to its own weight and returns to the accommodating chamber 18*b*.

At this time, the toner 22 can be temporarily deposited in the space 40 provided on the conveying surface 32*a* of the conveying sheet 32. As a result, the toner 22 can be temporarily deposited in the space 40 provided above the deposition surface 221 of the toner 22 accommodated in the accommodating chamber 18*b*.

At this time, the toner 22 deposited in the space 40 exists gravitationally above the toner 22 accommodated in the accommodating chamber 18*b*. As a result, the toner 22 deposited in the space 40 is in a state of high potential energy. As a result, the mechanical energy necessary for lifting the toner 22 accumulated on the bottom surface 18*b*1 in the accommodating chamber 18*b* to the opening 19*c* provided in the side wall 19*a* can be lowered by one step.

As a result, the toner 22 can be conveyed upward with less force. This makes it possible to reduce the rigidity of the agitating member 31, so that it is possible to suppress striking noise generated when the agitating member 31 rotating integrally with the shaft member 30 comes into contact with the developing frame 18 and rubbing noise generated when the agitating member 31 slides on the developing frame 18.

As in the modification described above with reference to FIG. 8, the displacement portion 322 of the conveying sheet 132 is brought into contact with the shaft member 30 or the agitating member 31. Even in such a configuration, the same effect can be obtained by forming the space 40 indicated by the cross-hatched portion in FIG. 9 in which the toner 22 can be temporarily deposited on the conveying surface 132*a* of the conveying sheet 132.

As shown in FIG. 9, a wedge-shaped portion V is formed between the side wall 19*a* and the conveying surface 32*a* of the conveying sheet 32. Even when the amount of the toner 22 accommodated in the accommodating chamber 18*b* is sufficiently large, or even when the amount of the toner 22 accommodated in the accommodating chamber 18*b* is small, the same effect can be obtained.

It should be noted that the present invention is not limited to the above-described various embodiments. The conveying sheet 32 may be disposed on the accommodating chamber 18*b* side of the partition wall 19 separating the developing chamber 18*a* and the accommodating chamber 18*b*. The fixed portion 321 of the conveying sheet 32 may be fixed to various positions other than the accommodating chamber surface 19*b*2 of the bottom wall 19*b*.

The developing device 4 of this embodiment is integrated in the process cartridge 7 so as to be detachably attached to the main body of the image forming apparatus 100. Alternatively, the developing device 4 may be fixed to the image forming apparatus 100, or the developing device 4 may be formed as a cartridge by itself and detachably attached to the main body of the image forming apparatus 100.

The image forming apparatus 100 of this embodiment is of an intermediate transfer type having an intermediate transfer belt 5 serving as an intermediate transfer member. The present invention can also be applied to an image forming apparatus having a conveying belt that is an endless belt serving as a recording material bearing member for bearing and conveying a recording material 12. In such an image forming apparatus, the toner image formed on the surface of a photosensitive drum 1 is directly transferred onto a recording material 12 borne on the conveying belt. In such an image forming apparatus, a conveying belt is disposed in place of the intermediate transfer belt 5, and an image forming unit 23 including a process cartridge 7 is disposed below the conveying belt. In this case, it is sometimes necessary to convey toner 22 against gravity in the developing device 4, and the present invention effectively works even in such a case.

According to this embodiment, when the toner 22 (developer) is conveyed against gravity, it is possible to suppress the falling of the toner 22 (developer) on the conveying sheets 32, 132. As a result, the toner 22 (developer) can be stably conveyed by cooperation of the agitating member 31 and the conveying sheet 32, 132, and the developing device 4 can be downsized.

According to the present invention, it is possible to suppress falling of the developer from the conveying member when the developer is conveyed against gravity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-007692 filed Jan. 19, 2017 and No. 2017-223651 filed Nov. 21, 2017, which are hereby incorporated by reference herein in their entirety.

What is claimed is:

1. A developing device comprising:

a frame including a developing chamber provided with a developer bearing member, an accommodating chamber accommodating developer, and a partition wall separating the developing chamber and the accommodating chamber from each other and provided with an opening connecting the developing chamber and the accommodating chamber;

an agitating member agitating the developer in the accommodating chamber;

a shaft member rotatably supported in the accommodating chamber, the shaft member being located below the opening in the gravitational direction and having an attachment portion to which the agitating member is attached; and a conveying member conveying the developer in the accommodating chamber, wherein the conveying member includes a fixed portion fixed to an inner wall of the frame forming the accommodating chamber and a displacement portion movable relative to the opening, wherein the displacement portion is located between the opening and the shaft member, and is movable from below the opening in the gravitational direction toward the opening by coming into contact with the agitating member, and wherein, in a direction perpendicular to a rotational axis of the shaft member, a distance between the rotational axis and the attachment portion is shorter than a shortest distance between the attachment portion and the inner wall, and the rotational axis is located within an imaginary circle centered at a boundary point between the fixed portion and the displacement portion and passing through a distal end of the displacement portion.

2. The developing device according to claim 1, wherein the agitating member is capable of coming into contact with the inner wall.

3. The developing device according to claim 2, wherein, in the direction perpendicular to the rotational axis, the rotational axis of the shaft member is located on the side of a distal end of the conveying member with respect to the opening.

4. The developing device according to claim 3, wherein, in the direction perpendicular to the rotational axis, while the conveying member and the agitating member are in contact with each other, the attachment portion is located is located on the side of the distal end of the conveying member with respect to the opening.

5. The developing device according to claim 1, wherein the conveying member can be brought into contact with the shaft member or the agitating member by at least one of resilience and own weight of the conveying member.

6. The developing device according to claim 1, wherein the conveying member forms a space for temporarily storing the developer between the conveying member and the partition wall provided with the opening.

7. The developing device according to claim 1, wherein an angle formed between the partition wall provided with the opening and a horizontal direction is a positive value in a direction in which the conveying member is moved by the agitating member.

8. The developing device according to claim 1, wherein a surface of the conveying member on the side opposite to the surface with which the agitating member comes into contact is fixed to the partition wall.

9. An image forming apparatus comprising:

the developing device according to claim 1;

an image bearing member on which an electrostatic latent image is formed; and an exposure device exposing the image bearing member, wherein the image forming apparatus forms an image on a recording material using the developer.

10. A developer container comprising:

a frame including a first chamber, a second chamber accommodating developer, and a partition wall separating the first chamber and the second chamber from each other and provided with an opening connecting the first chamber and the second chamber;

an agitating member agitating the developer in the second chamber;

a shaft member rotatably supported in the second chamber, the shaft member being located below the opening in the gravitational direction and having an attachment portion to which the agitating member is attached; and a conveying member conveying the developer in the second chamber, wherein the conveying member includes a fixed portion fixed to an inner wall of the frame forming the second chamber and a displacement portion movable relative to the opening, wherein the displacement portion is located between the opening and the shaft member, and is movable from below the opening in the gravitational direction toward the opening by coming into contact with the agitating member, and wherein, in a direction perpendicular to a rotational axis of the shaft member, a distance between the rotational axis and the attachment portion is shorter than a shortest distance between the attachment portion and the inner wall, and the rotational axis is located within an imaginary circle centered at a boundary point between the fixed portion and the displacement portion and passing through a distal end of the displacement portion.

11. The developer container according to claim 10, wherein the agitating member is capable of coming into contact with the inner wall.

12. The developer container according to claim 11, wherein, in the direction perpendicular to the rotational axis, the rotational axis of the shaft member is located on the side of a distal end of the conveying member with respect to the opening.

13. The developer container according to claim 12, wherein, in the direction perpendicular to the rotational axis, while the conveying member and the agitating member are in contact with each other, the attachment portion is located is located on the side of the distal end of the conveying member with respect to the opening.

14. The developer container according to claim 10, wherein the conveying member can be brought into contact with the shaft member or the agitating member by at least one of resilience and own weight of the conveying member.

15. The developer container according to claim 10, wherein the conveying member forms a space for temporarily storing the developer between the conveying member and the partition wall provided with the opening.

16. The developer container according to claim 10, wherein an angle formed between the partition wall provided with the opening and a horizontal direction is a positive value in a direction in which the conveying member is moved by the agitating member.

17. The developer container according to claim 10, wherein a surface of the conveying member on the side opposite to the surface with which the agitating member comes into contact is fixed to the partition wall.

18. An image forming apparatus comprising:

the developer container according to claim 10;

an image bearing member on which an electrostatic latent image is formed; and an exposure device exposing the image bearing member, wherein the image forming apparatus forms an image on a recording material using the developer.

19. A process cartridge comprising:

a developing device including, a frame including a developing chamber provided with a developer bearing member, an accommodating chamber accommodating developer, and a partition wall separating the developing chamber and the accommodating chamber from each other and provided with an opening connecting the developing chamber and the accommodating chamber, an agitating member agitating the developer in the accommodating chamber, a shaft member rotatably supported in the accommodating chamber, the shaft member being located below the opening in the gravitational direction and having an attachment portion to which the agitating member is attached, and a conveying member conveying the developer in the accommodating chamber, wherein the conveying member includes a fixed portion fixed to an inner wall of the frame forming the accommodating chamber and a displacement portion movable relative to the opening, wherein the displacement portion is located between the opening and the shaft member, and is movable from below the opening in the gravitational direction toward the opening by coming into contact with the agitating member, and wherein, in a direction perpendicular to a rotational axis of the shaft member, a distance between the rotational axis and the attachment portion is shorter than a shortest distance between the attachment portion and the inner wall, and the rotational axis is located within an imaginary circle centered at a boundary point between the fixed portion and the displacement portion and passing through a distal end of the displacement portion, and an image bearing member that faces the developer bearing member and on which an electrostatic latent image is formed.

20. An image forming apparatus comprising:

the process cartridge according to claim 19; and an exposure device exposing the image bearing member, wherein the image forming apparatus forms an image on a recording material using the developer.

* * * * *